US005927190A

United States Patent [19]

Yoshimoto et al.

[11] Patent Number: 5,927,190

[45] Date of Patent: Jul. 27, 1999

[54] PRINTING MACHINE

[75] Inventors: Kenji Yoshimoto; Masami Kanehira; Yoshinori Tanaka; Takeshi Fujimura, all of Ibaraki-ken, Japan

[73] Assignee: Riso Kagaku Corporation, Tokyo, Japan

[21] Appl. No.: 09/102,197

[22] Filed: Jun. 22, 1998

[30] Foreign Application Priority Data

Jun. 27, 1997 [JP] Japan ..... 9-171761

[51] Int. Cl.[6] ..... B41L 13/00

[52] U.S. Cl. ..... 101/118; 101/116

[58] Field of Search ..... 101/114, 116, 101/117, 118, 119, 120, 128.4, 129, 232, 477

[56] References Cited

U.S. PATENT DOCUMENTS 4,256,037 3/1981 Vertegaal ..... 101/115
5,323,706 6/1994 Sugawara ..... 101/477
5,513,565 5/1996 Hasegawa ..... 101/116
5,857,410 1/1999 Watanabe et al. ..... 101/116

*Primary Examiner*—Ren Yan
*Attorney, Agent, or Firm*—Kanesaka & Takeuchi

[57] ABSTRACT

A printing machine comprises a printing drum rotationally driven around a central axis of itself. The drum has a cylindrical circumferential wall with an ink-permeable image area and an ink supplying device disposed to an inside of the circumferential wall for supplying ink to an inner surface of the circumferential wall. The machine also comprises a rotatable press roller vertically movably disposed below the drum and for sandwiching a printing body between the drum and the press roller. The machine also comprises a first supporting roller and a second supporting roller. The first supporting roller is disposed before the press roller in a printing body conveyance direction. The second supporting roller is disposed after the press roller in the printing body conveyance direction. Both the first and the second rollers are vertically movable in synchronization with a vertical movement of the press roller and supporting the printing body to be movable in the printing body conveyance direction.

9 Claims, 38 Drawing Sheets

PRINTING MACHINE

BACKGROUND OF THE INVENTION

The present invention concerns a stencil printing machine which is capable of conducting stencil printing on a printing body, such as cardboard or corrugated cardboard, made of any material which is printable with ink.

In an existent printing method for a printing body like corrugated cardboard, a printing machine having a flat screen has been used. In using such a machine, ink is squeezed out through an opening formed in the screen onto the printing body.

According to the conventional printing machine thus constituted, in the case where an identical image is to be printed on different plural portions of a single printing body, the printing body must be reset in another position after previous printing operation has been finished, and then next printing on the same printing body is resumed. Now, a corrugated cardboard box having an identical printed image on plural faces thereof will be considered. For example, in the case where a corrugated cardboard for the box is to be printed, the identical image may be printed on different plural portions of the corrugated cardboard so that the identical image can be seen on the plural faces of the box erected by folding the corrugated cardboard. In this case the corrugated cardboard must be positioned to the machine in each printing process for each portion. Such troublesome operation requires a long time and much effort.

An object of the present invention is to solve the problems described above, thereby providing a printing machine capable of successively printing an identical image on different plural portions of a single printing body.

SUMMARY OF THE INVENTION

A printing machine as defined in the first aspect of the present invention comprises a printing drum rotationally driven around a central axis of itself and including a cylindrical circumferential wall with an ink-permeable image area and ink supplying means disposed to an inside of the circumferential wall for supplying ink to an inner surface of the circumferential wall; a press roller vertically movably disposed below the printing drum, the press roller being adapted to press a printing body to be printed onto the outer surface of the printing drum so that an image of ink is printed onto the printing body; a first supporting roller disposed before the press roller in a direction of conveying the printing body, the first supporting roller being vertically movable in synchronization with a vertical movement of the press roller, and being adapted to support the printing body so that the printing body is movable in a direction of conveying the printing body; and a second supporting roller disposed after the press roller in the direction of conveying the printing body, the second supporting roller being vertically movable in synchronization with the vertical movement of the press roller, and being adapted to support the printing body so that the printing body is movable in the direction of conveying the printing body.

A printing machine as defined in the second aspect of the present invention comprises a printing drum rotationally driven around a central axis of itself, and including a cylindrical circumferential wall with an ink-permeable image area and ink supplying means disposed to an inside of the circumferential wall for supplying ink to an inner surface of the circumferential wall; a press roller vertically movably disposed between a printing position where the press roller and the printing drum hold a printing body and a receiving position below the printing position; a first supporting roller disposed before the press roller in a direction of conveying the printing body, the first supporting roller being vertically movable in synchronization with a vertical movement of the press roller, and being adapted to support the printing body so that the printing body is movable in the direction of conveying the printing body; and a second supporting roller disposed after the press roller in the direction of conveying the printing body, the second supporting roller being vertically movable in synchronization with the vertical movement of the press roller, and being adapted to support the printing body so that the printing body is movable in the direction of conveying the printing body.

A printing machine as defined in the third aspect of the present invention further comprises a vertically movable base member on which the press roller, the first supporting roller and the second supporting roller are disposed at a same vertical level in the printing machine as defined in the second aspect of the present invention.

A printing machine as defined in the fourth aspect of the present invention further comprises a printing body conveyance surface disposed before the first supporting roller in the direction of conveying the printing body at a same vertical level as the receiving position in the printing machine as defined in the third aspect of the present invention.

A printing machine as defined in the fifth aspect of the present invention further comprises an idle roller vertically movably disposed above the first supporting roller, the idle roller being adapted to hold the printing body conveyed along the conveyance surface between the first supporting roller and the idle roller in the printing machine as defined in the fourth aspect of the present invention.

In a printing machine as defined in the sixth aspect of the present invention, the first supporting roller is driven by driving means connected thereto, and the press roller and the second supporting roller are driven by conveyance of the printing body in the printing machine as defined in the fifth aspect of the present invention.

A printing machine as defined in the seventh aspect of the present invention further comprises a one-way clutch disposed between the first supporting roller and the driving means in the printing machine as defined in the sixth aspect of the present invention.

A printing machine as defined in eighth aspect of the present invention further comprises detecting means for detecting that a leading end of the printing body reaches the press roller, the printing body being conveyed by the first roller and the idle roller in the printing machine as defined in the seventh aspect of the present invention.

A printing machine as defined in the ninth aspect of the present invention further comprises control means for controlling the printing machine in such a manner that: the printing drum is set in a print start position; the printing body is firstly printed by rotating the printing drum after being held by the leading end of itself between the printing drum and the press roller; the base member moves downwardly with the printing body held between the first supporting roller and the idle roller; the printing drum rotates to be set in the print start position again; and the printing body is secondly printed by rotating the printing drum after being held between the printing drum and the press roller by moving the base member upwardly in the printing machine as defined in the eighth aspect of the present invention.

DETAILED DESCRIPTION OF PREFERRED EMBODIMENTS

Referring to FIGS. 1–38, one embodiment of the present invention will be explained.

Figure 1:
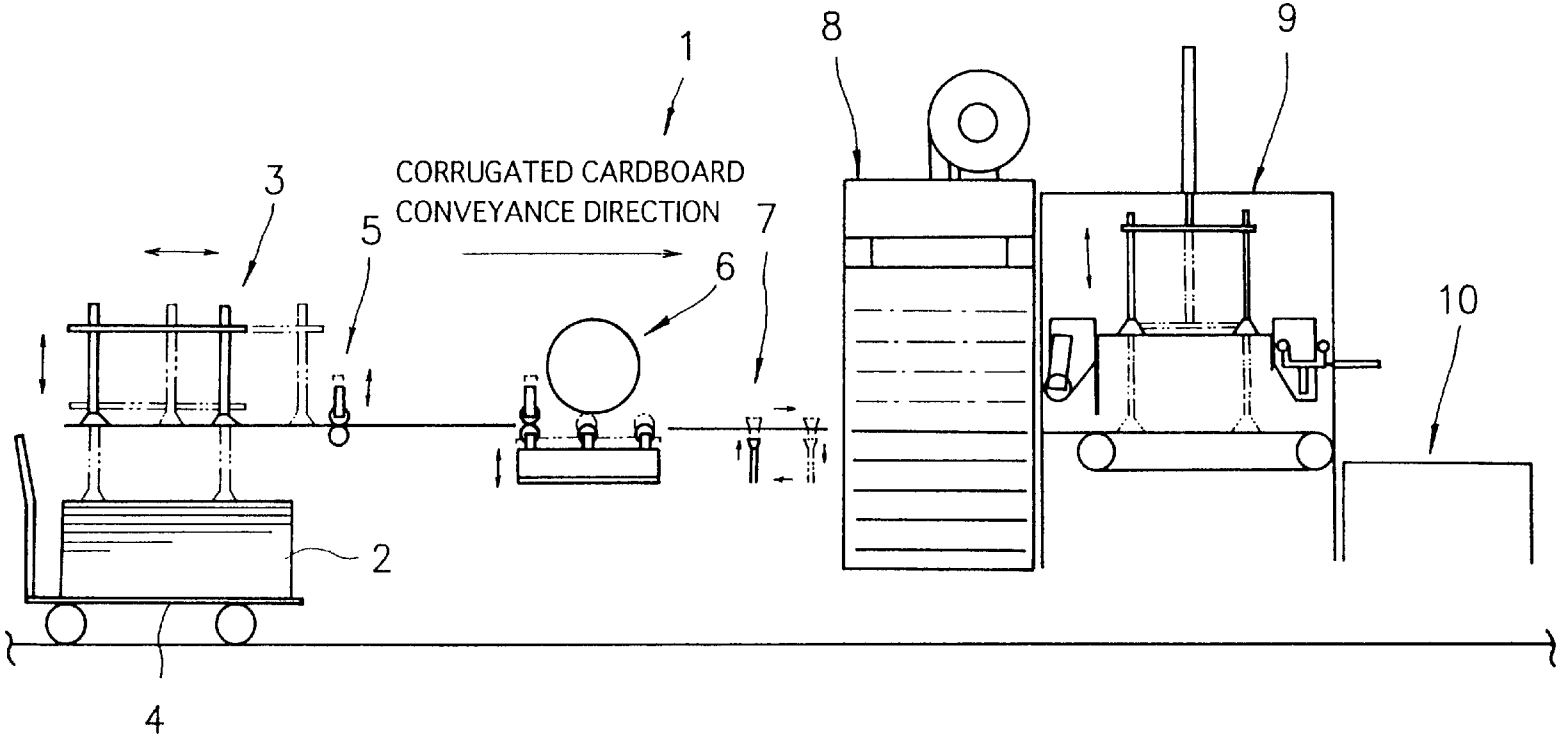
FIG. 1 is an entire view, partially simplified, of a printing machine in one embodiment according to the present invention.

FIG. 1 is an entire view, partially simplified, of a printing machine in one embodiment according to the present invention. The object of the printing machine is to print corrugated cardboard having flaps, which cardboard is unfolded to be a long flat shape. The printing machine functions not only as a stencil printer for corrugated cardboard but as bonding means to join both ends of the long flat cardboard. A corrugated cardboard box is formed from the long flat corrugated cardboard by bonding both the ends of the cardboard, putting it up, and adequately assembling the flaps.

Referring to FIG. 1, the entire constitution of the present printing machine will be explained. The printing machine comprises a cardboard feeding section 3 that fetches supplied corrugated cardboard 2 one by one. After placing a supply car, on which cardboard is piled up, in a predetermined position of the cardboard feeding section 3, the cardboard 2 is supplied to the cardboard feeding section 3. In a right cardboard-conveyance direction illustrated in FIG. 1, a first conveying section 5 is disposed next to the feeding section 3 for conveying the cardboard 2 stored in the section 3. Next to the first conveying section 5, a printing section 6 is disposed for conducting stencil printing on the cardboard 2 sent by the first conveying section 5. A second conveying section 7 is disposed next to the printing section 6 for conveying the printed cardboard to a next process. Next to the second conveying section 7, a drying section 8 is disposed for receiving the printed cardboard 2 and drying ink on it. A box assembling section 9 is disposed next to the drying section 8 for bonding both the ends of the dried printed cardboard 2. Next to the box assembling section 9, a discharge section 10 is disposed for receiving and stacking the bonded cardboard 2.

The present printing machine 1 is capable of conducting stencil printing on plural portions of the unfolded flat cardboard 2, drying it, bonding both the ends thereof and then discharging it. The operation of bonding both the ends loops the flat discharged cardboard 2. Putting up the looped cardboard 2 in a box-shape and then properly assembling the flaps thereof can form a corrugated cardboard box.

Next, explanation will be made to constitution, function, and operation of each section in the present printing machine 1. Firstly, the cardboard feeding section 3, the first conveying section 5 and the printing section 6 will be explained.

(1) Cardboard Feeding Section 3

Figure 2:
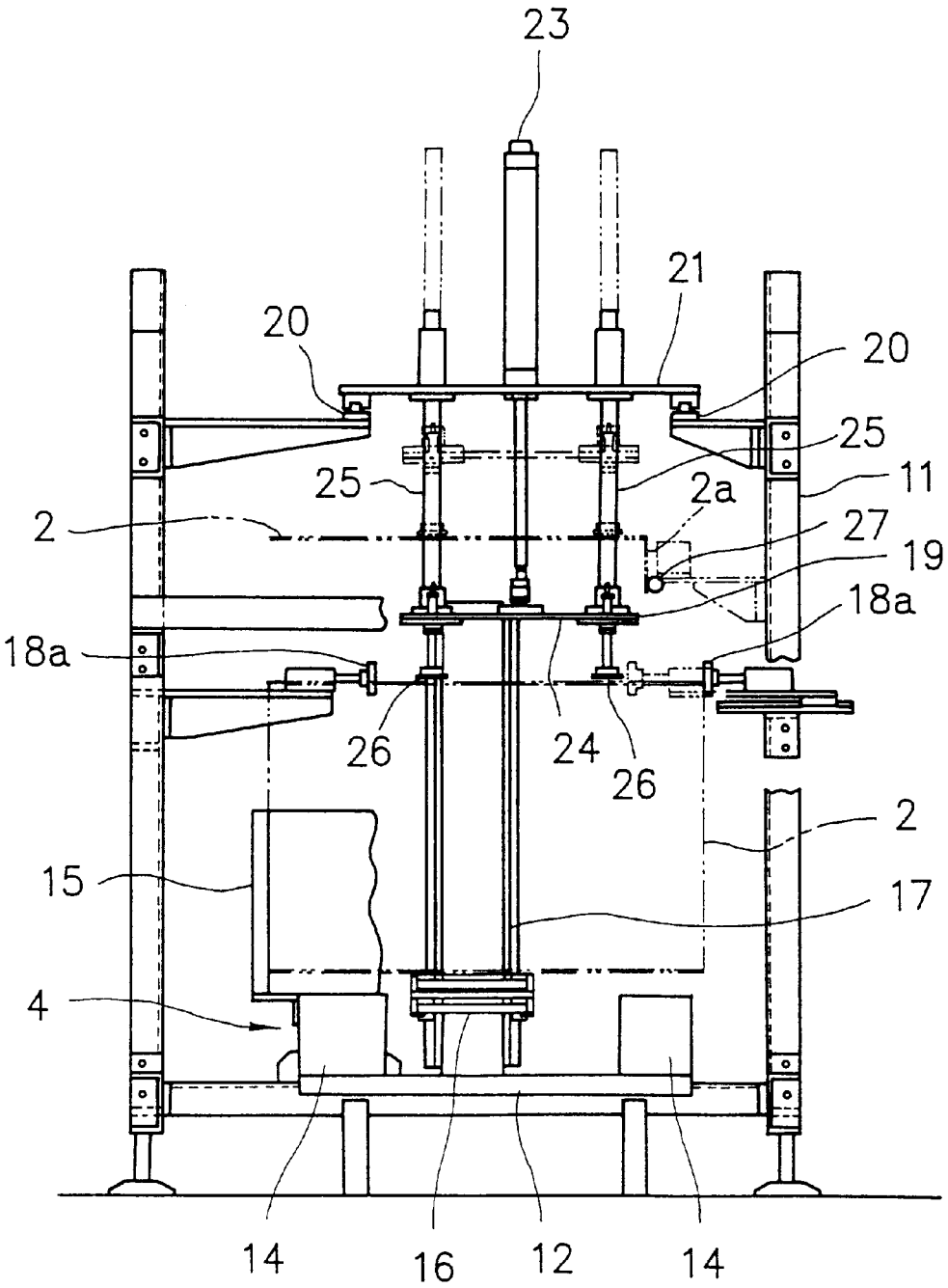
FIG. 2 is a left side view of a cardboard feeding section, a first conveying section, and a printing section of the printing machine in one embodiment according to the present invention.
Figure 3:
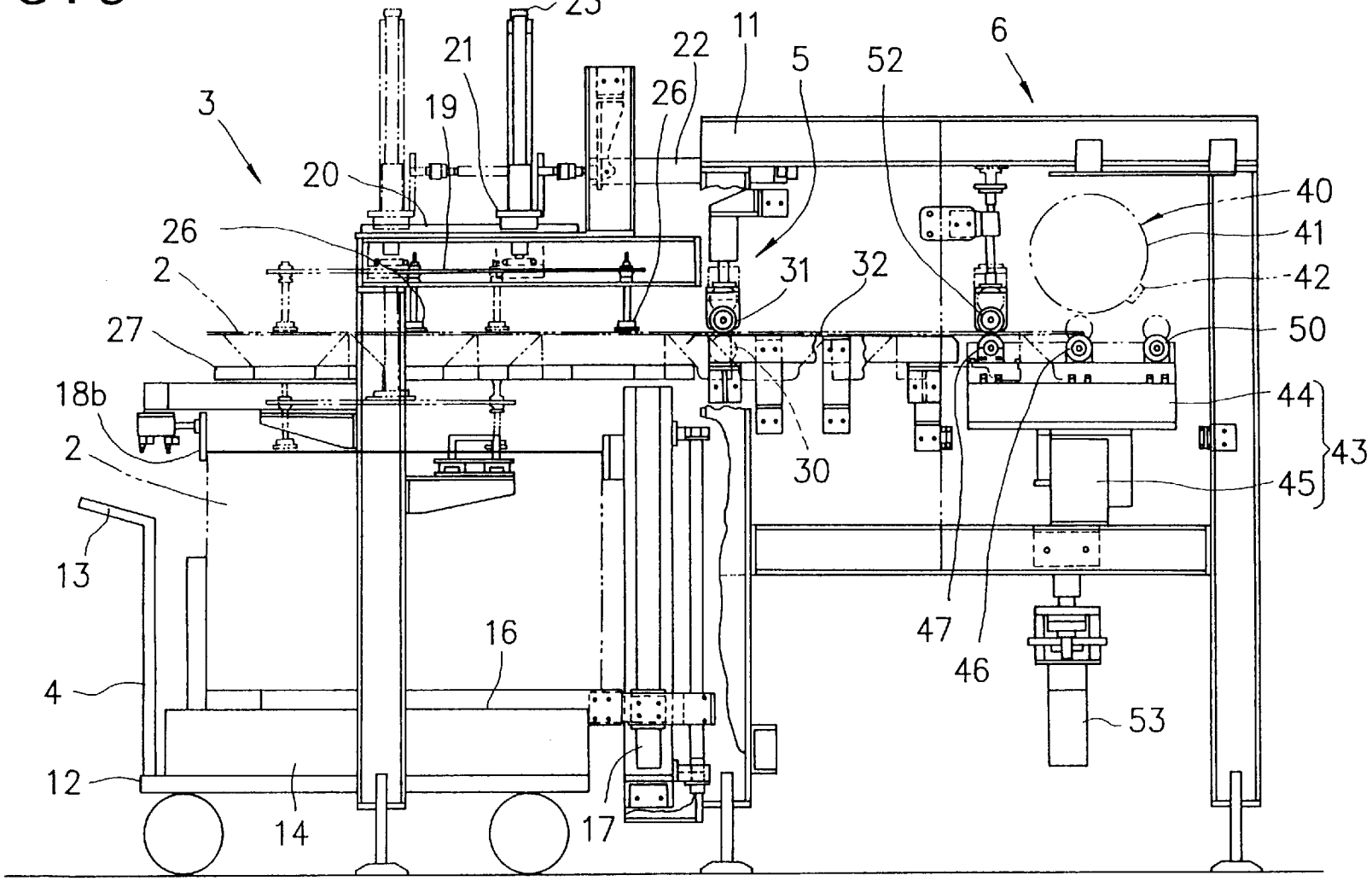
FIG. 3 is an elevation view of a cardboard feeding section, a first conveying section, and a printing section of the printing machine in one embodiment according to the present invention.
Figure 4:
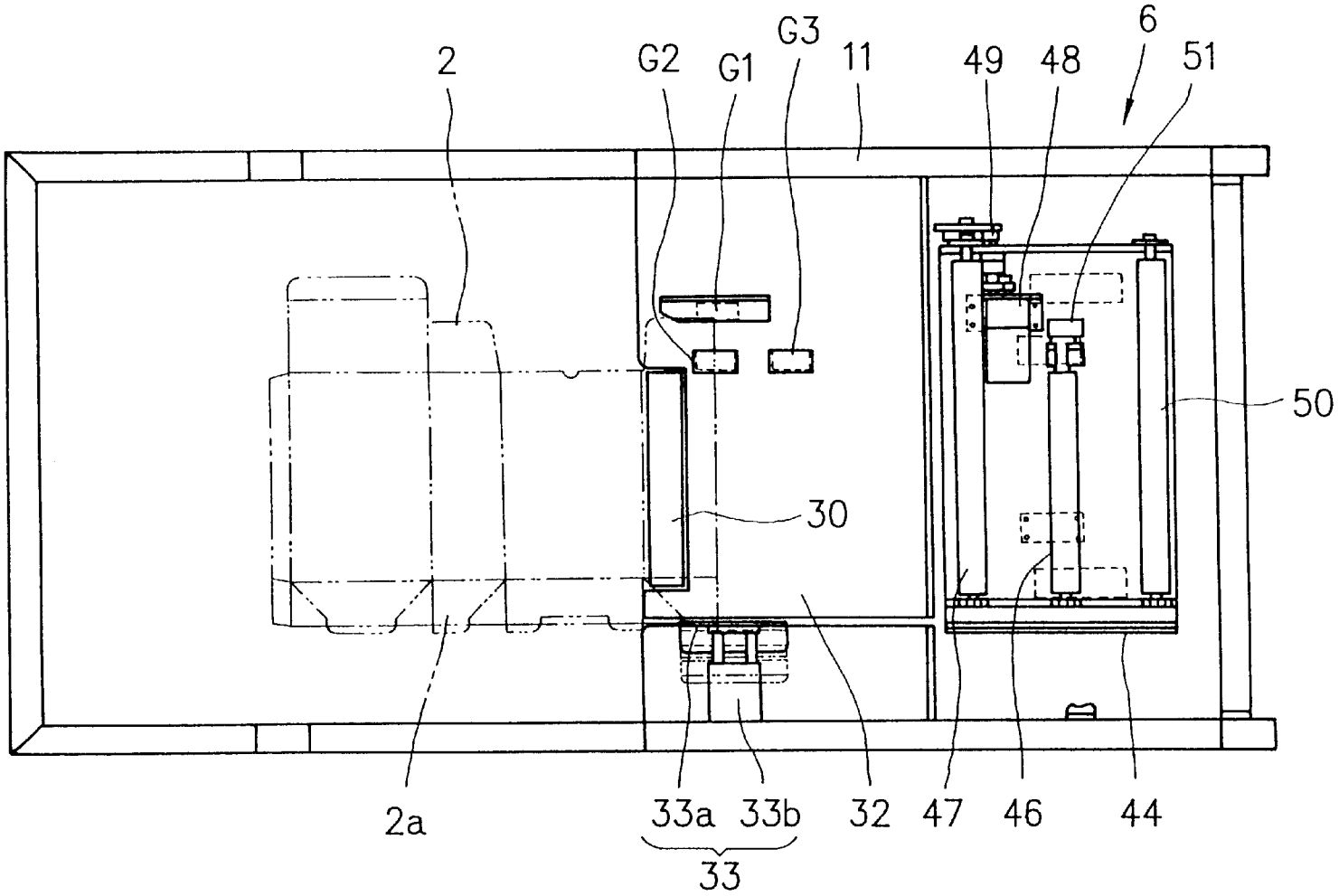
FIG. 4 is a plan view of a cardboard feeding section, a first conveying section, and a printing section of the printing machine in one embodiment according to the present invention.

As can be seen from FIGS. 2–4, a frame 11 is approximately parallelepiped. The left half of the frame 11 includes a space. The supply car 4 for cardboard-supply moves on a floor and enters the space. The supply car 4 comprises a base 12 and a handle attached to the base 12 for pushing it. A pair of spacers 14, 14 are disposed at a predetermined distance on the base 12. A wall 15 is disposed on a side surface of one spacer 14. The cardboard 2 is stacked on the spacers 14, 14. The bottom cardboard 2 and the upper surface of the base 12 are separated by a space therebetween.

As shown in FIGS. 2 and 3, the frame includes a table 16 as supplying means of the corrugated cardboard 2. The table 16 is elongated and approximately rectangular. The table 16, one end of which is supported by a vertical guide rail, is vertically movable in a cantilever method. After being inserted between a pair of the spacers 14,14, the table 16 lifts the corrugated cardboard 2 that is stacked on the spacers 14,14. The top corrugated cardboard 2 on the supply car 4 is arranged in a predetermined fetching height by vertical movement of the table 16. After one fetching operation, the table 16 ascends by a height corresponding to the corrugated cardboard thickness, thereby arranging the next cardboard 2 in the fetching height.

As shown in FIGS. 2 and 3, positioning members 18 (18*a*, 18*b*) are disposed above the feeding section. The positioning members 18 arrange the corrugated cardboard 2, which is set in the fetching height, in a predetermined horizontal fetching position. The positioning member 18*a* is disposed for pushing both the side-ends of the corrugated cardboard 2; also, the positioning member 18*b* is for aligning the leading end of the corrugated cardboard 2 with a predetermined position by pushing the rear end. Air cylinders as driving means move the positioning members 18*a*, 18*b*.

As shown in FIGS. 2 and 3, fetching means 19 is disposed above the fetching position. A pair of rails 20, 20 are fixed to the frame 11 to be parallel to a horizontal feeding direction (right direction in FIG. 3). On the rail 20, a base plate 21 is disposed movably along the feeding direction. An air cylinder 22 as driving means is attached to the frame 11 parallel to a feeding direction. The rod of the air cylinder 22 is fixed to the base plate 21. Operating the air cylinder 22 reciprocates the base plate 21 in the feeding direction. On the base plate 21, an air cylinder 23 as driving means is disposed downwards. A rod of the air cylinder 23 is directed downwards. A frame 24 is attached to the lower end of the rod. Operating the air cylinder 23 reciprocates the frame 24 vertically. A guiding mechanism 25 disposed between the frame 24 and the base plate 21 stabilizes the vertical movement of the frame 24. On the frame 24, a plural holding means 26 are disposed. The holding means 26 catch the corrugated cardboard 2 in the fetching position. Four vacuum-suction cups function as the holding means 26 in the present embodiment.

As shown in FIGS. 2 and 3, a pipe 27 is arranged in a height between the fetching position and a conveyance surface 32. The pipe 27 in the position extends along a flap 2*a* of the corrugated cardboard 2. When the fetching means 19 lifts a relatively large-sized corrugated cardboard 2, the flap 2*a* of which cardboard 2 meets the pipe 27; then, the flap 2*a* is bent downwards as illustrated in imaginary lines in FIG. 2. In the case where the corrugated cardboard is relatively large, the pipe 27 bends the flap 2*a*, thereby preventing the cardboard from being jammed in later processes.

An operation of the present embodiment will be explained. Operating the two air cylinders 22, 23 move the holding means 26. The corrugated cardboard 2 is, after being arranged in the fetching position, held by the holding means 26. The corrugated cardboard 2 is lifted by the air cylinder 23 and arranged in the predetermined conveyance surface. Further, the cardboard 2 is arranged in a conveyance start position by the air cylinder 23. The first conveying section 5 is disposed adjacent to the cardboard feeding section. The section 5 includes a drive roller 30 and an idle roller 31. The drive roller 30 and the idle roller 31 clamp the corrugated cardboard 2 by its leading end after the cardboard is arranged in the conveyance start position. After being clamped, the corrugated cardboard 2 is released from the holding means 26. And then, the first conveying section 5 conveys the corrugated cardboard 2.

(2) First Conveying Section 5

FIGS. 2–4 specifically show that the first conveying section 5 is disposed approximately in the center of the frame 11. The first conveying section 5 includes a conveyance surface 32. The drive roller 30, of which driving axis is perpendicular to the Ceding direction, is disposed at the entrance of the first conveying section 5. The top of the drive roller 30 is arranged approximately in the conveyance surface 32. Above the drive roller 30, the idle roller 31 is disposed parallel with it. The idle roller 31 is rotatable; however, the roller also can be clamped when required. An air cylinder moves the idle roller 31 vertically. A downward movement of the idle roller 31 holds the corrugated cardboard 2 that is inserted between the idle roller 31 and the drive roller 30. The leading end of the corrugated cardboard 2 supplied by the feeding section 3 is set to be located between the idle roller 31 and the drive roller 30.

As shown in FIG. 4, on the conveyance surface 32, there are disposed three guiding means: first guiding means G1, second guiding means G2, and third guiding means G3. The position and the shape of the guiding means G1–G3 are determined according to the shape of the corrugated cardboard 2. The guiding means G1–G3 protrude and retract from the conveyance surface 32 according to the outer shape of the corrugated cardboard 32.

As shown in FIG. 4, positioning means 33 is disposed on one side of the conveyance surface 32. The positioning means 33 locates the corrugated cardboard 2 conveyed by the first conveying section 5 relative to the printing section 6. The positioning means 33 includes a positioning member 33*a* and driving means 33*b* that moves the positioning member 33*a* in a direction perpendicular to the cardboard feeding direction.

Referring to FIGS. 5–10, a positioning operation of the corrugated cardboard 2 by using the guiding means G1–G3 and the positioning means 33 will be explained. For clarifying which guiding means functions, the guiding means that protrudes over the conveyance surface 32 is cross-hatched in the drawings.

Figure 5:
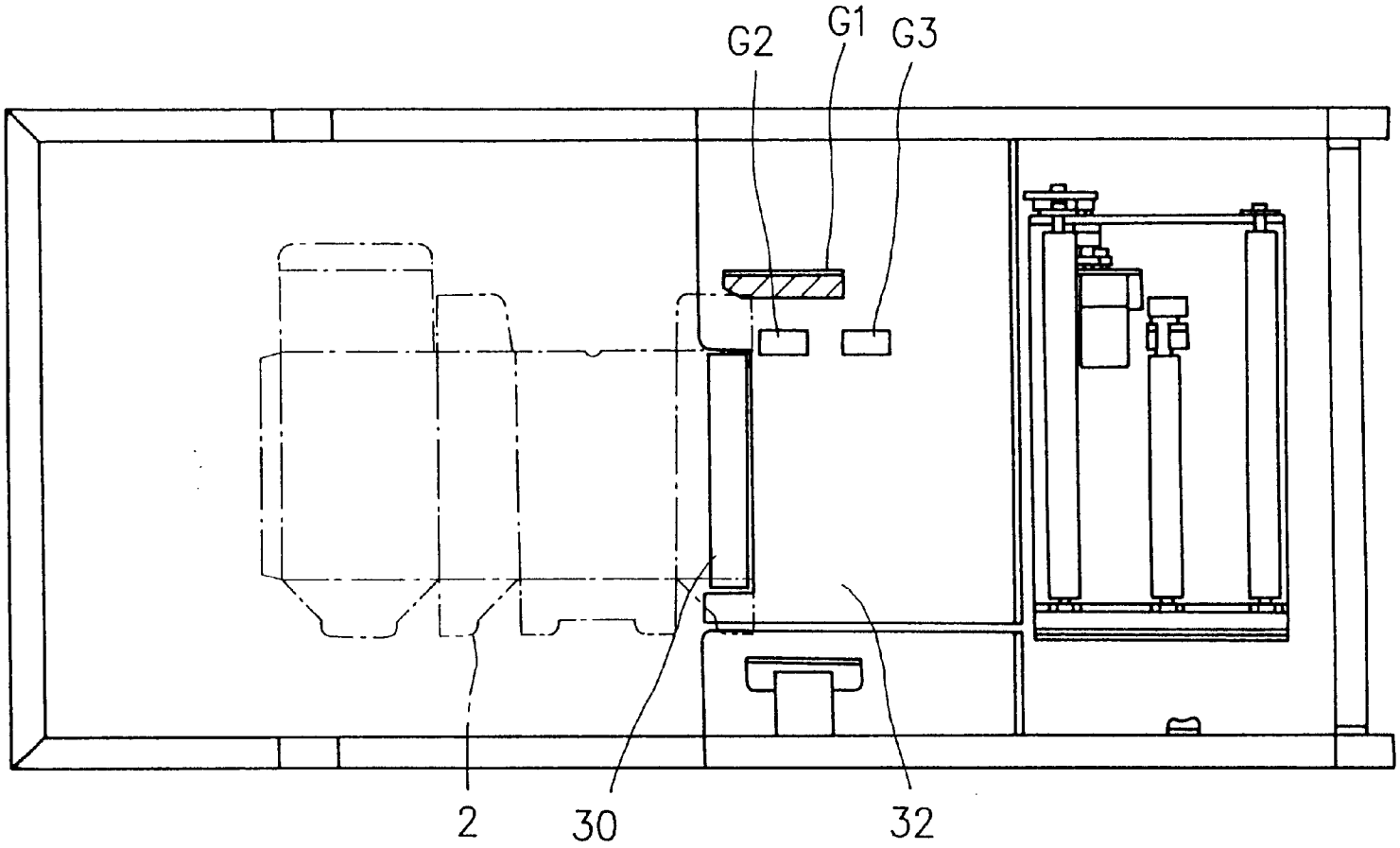
FIG. 5 is a plan view illustrating an operation in positioning cardboard in a first conveying section of one embodiment according to the present invention.

FIG. 5 illustrates a state where the first conveying means 5 is ready to start conveying the corrugated cardboard 2. The leading end of the corrugated cardboard 2 is held between the drive roller 30 and the idle roller 31 disposed above in the first conveying section 5. The guiding means G1 is positioned higher while the guiding means G2, G3 lower.

Figure 6:
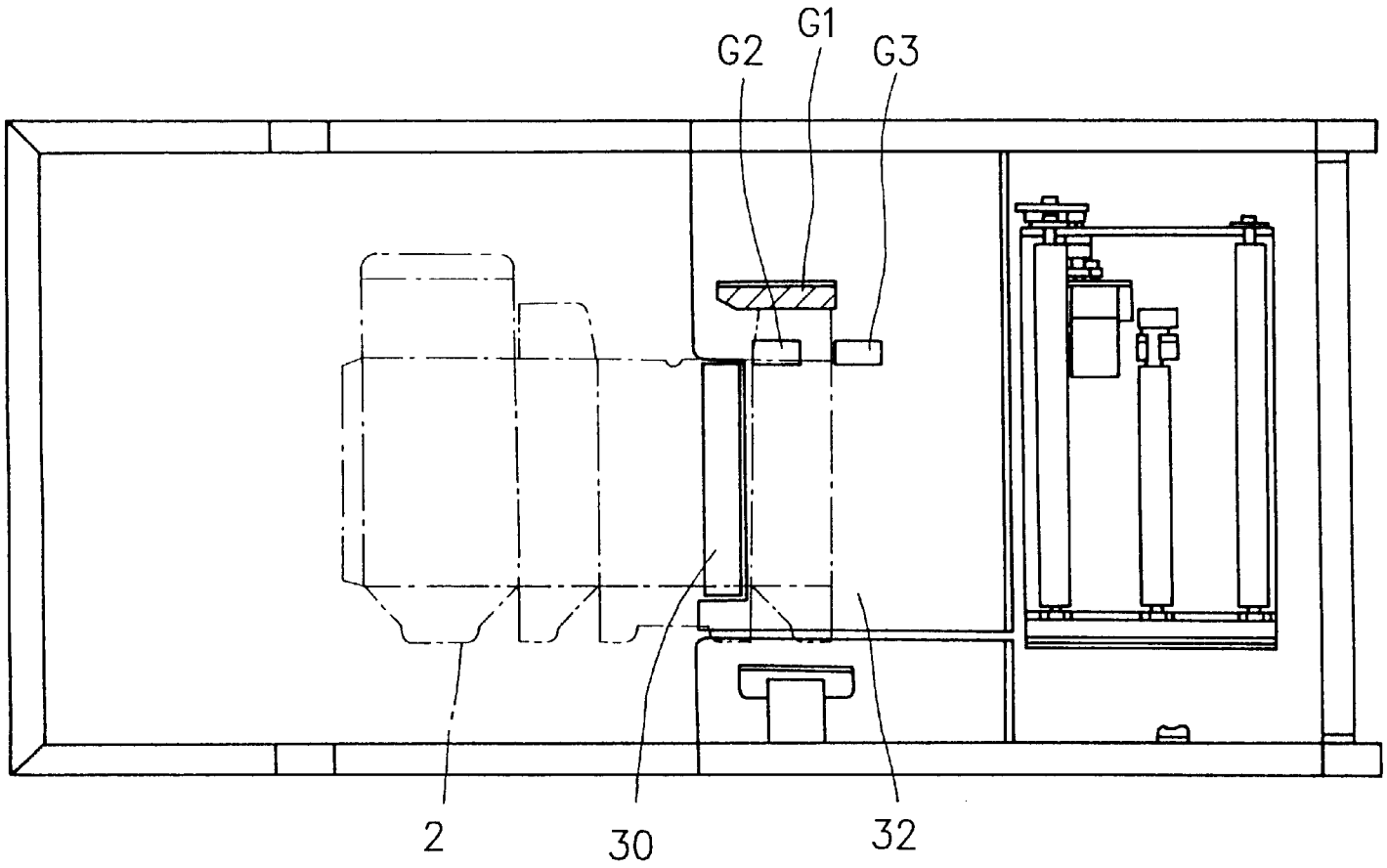
FIG. 6 is a plan view illustrating an operation in positioning cardboard in a first conveying section of one embodiment according to the present invention.

As shown in FIG. 6, conveyance of the corrugated cardboard 2 starts. The guiding means G1 guides a side edge of the flap of the corrugated cardboard 2.

Figure 7:
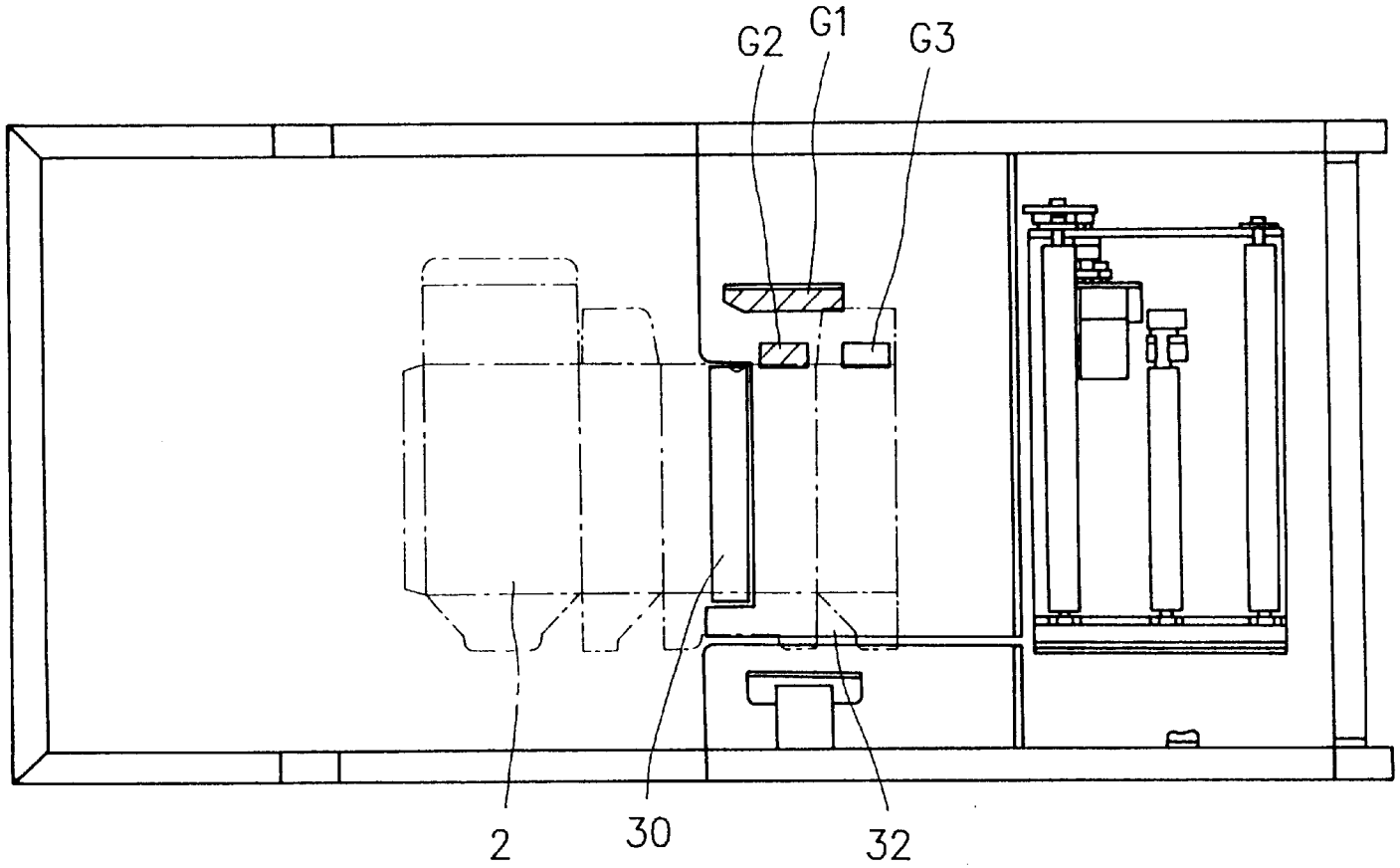
FIG. 7 is a plan view illustrating an operation in positioning cardboard in a first conveying section of one embodiment according to the present invention.

As shown in FIG. 7, just before the guiding means G1 departs from the side edge of the flap of the corrugated cardboard 2, the guiding means G2 protrudes and then starts to guide a side edge of the corrugated cardboard 2.

Figure 8:
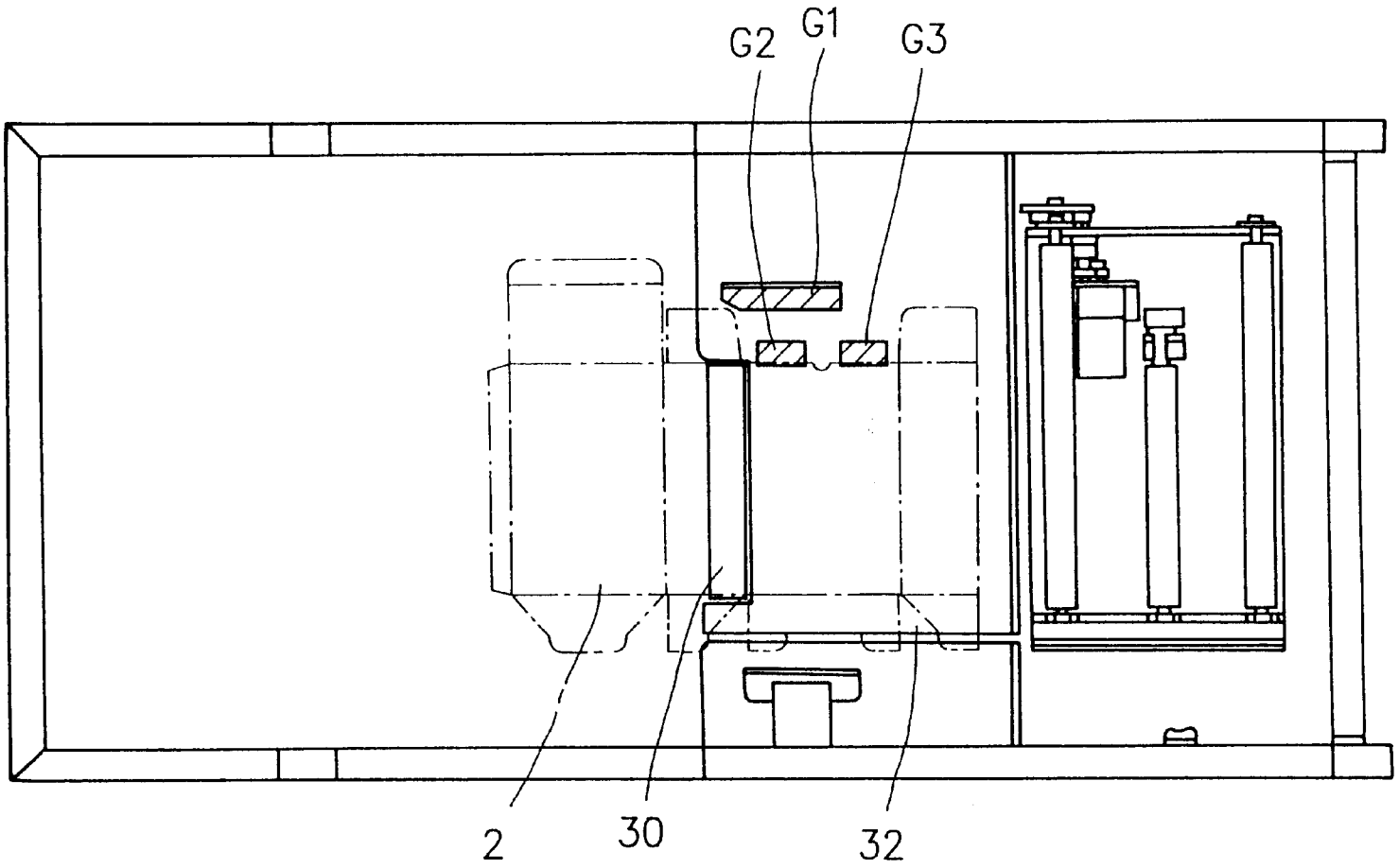
FIG. 8 is a plan view illustrating an operation in positioning cardboard in a first conveying section of one embodiment according to the present invention.

As shown in FIG. 8, the guiding means G3 protrudes. The guiding means G2, G3 guides the side edge of the corrugated cardboard 2.

Figure 9:
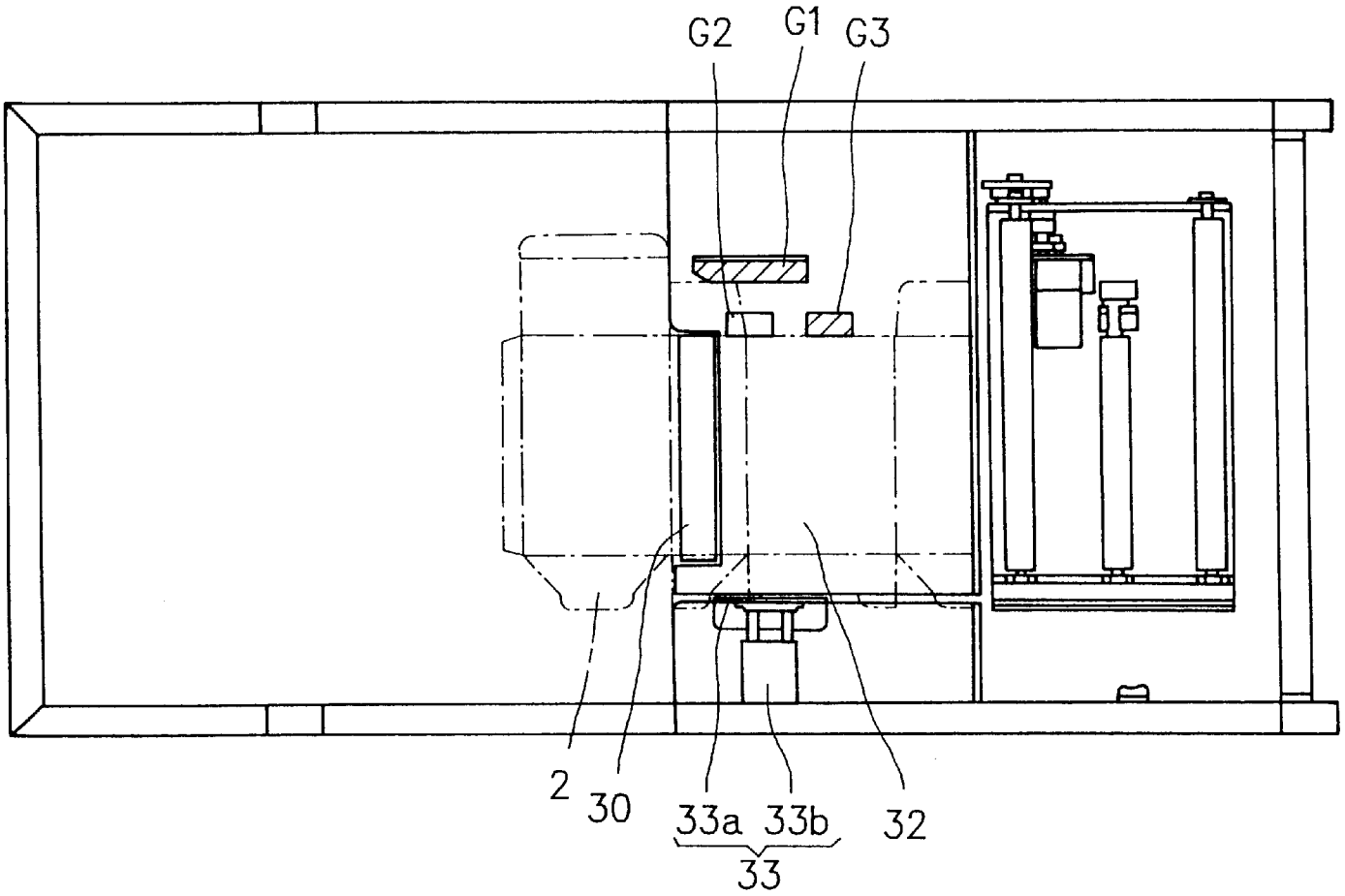
FIG. 9 is a plan view illustrating an operation in positioning cardboard in a first conveying section of one embodiment according to the present invention.

As shown in FIG. 9, the guiding means G2 retracts to avoid the flap of the corrugated cardboard 2. And then, downward pushing by the idle roller 31 is released before the positioning means 33 operates. Namely, the positioning member 33*a* pushes the side edge of the corrugated cardboard 2 in a direction perpendicular to the conveyance direction, thereby forcing the cardboard against the guiding means G1, G2. In this way the corrugated cardboard 2 is located precisely in a predetermined position on the conveyance surface 32. After positioning, the idle roller 31 again holds the corrugated cardboard 2, and the positioning member 33*a* is restored to the initial position.

Figure 10:
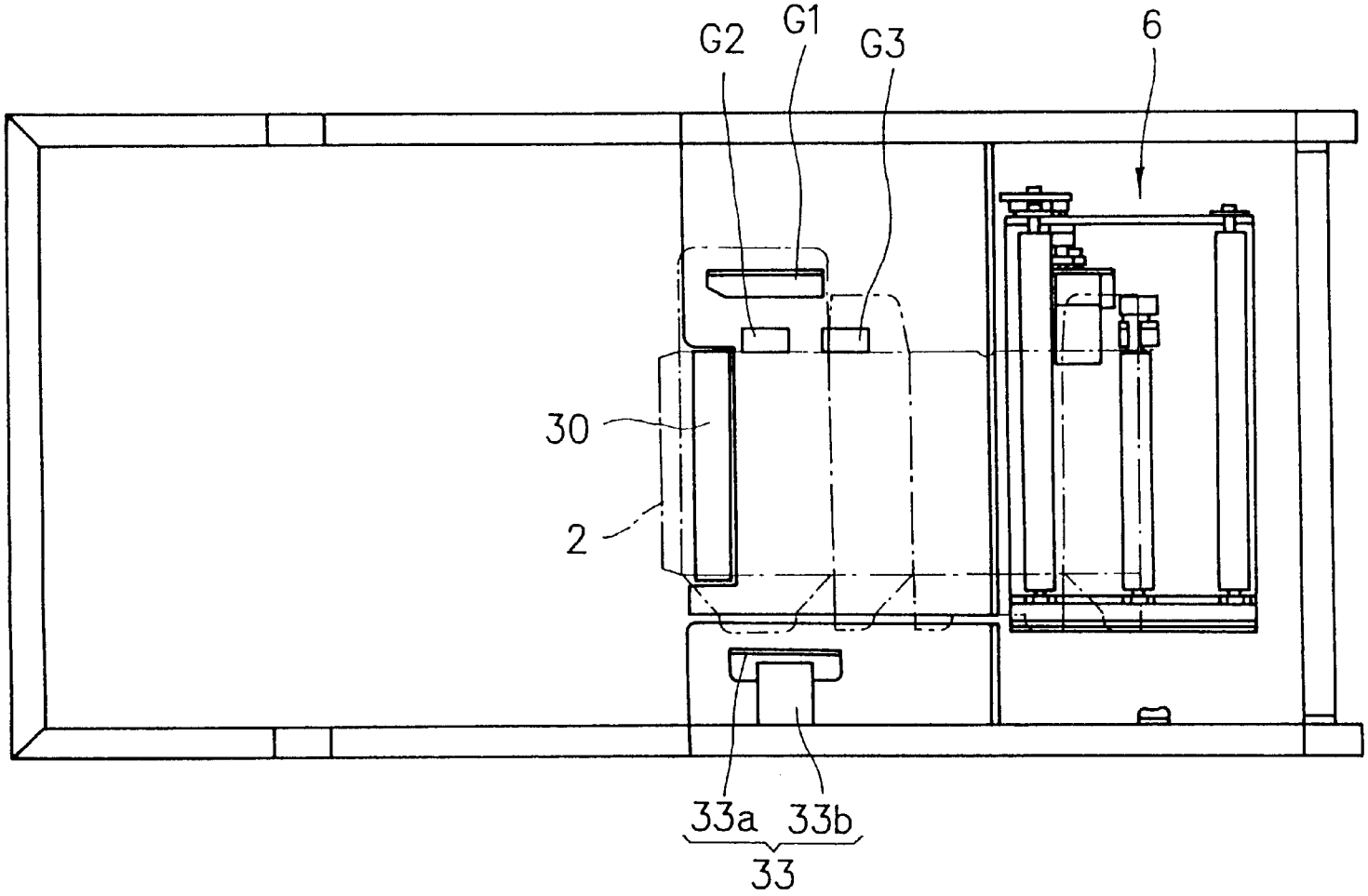
FIG. 10 is a plan view illustrating an operation in positioning cardboard in a first conveying section of one embodiment according to the present invention.

The conveyance of the corrugated cardboard 2 is resumed. As illustrated in FIG. 10, the guiding means G1, G3 retract successively to avoid interaction against the corrugated cardboard 2. Meanwhile, the leading end of the corrugated cardboard 2 reaches the printing section 6.

(3) Printing Section 6

FIGS. 2–4 specifically show that the printing section 6 is disposed to the right end in the frame 11. The printing section 6 includes a printing drum 40. The printing drum 40 is disposed to a predetermined position in the frame 11 and driven around a horizontal center axis of itself. The printing drum 40 includes a cylindrical peripheral wall 41. The peripheral wall 41 has a perforated ink-permeable printing region. On a non-printing region of the peripheral wall 41, there is disposed a clamping device 42 for clamping one end of a stencil sheet. The perforated stencil sheet, after being clamped by its leading end, is wrapped around the outer peripheral surface of the peripheral wall 41. Ink supplying means is disposed to the inside of the peripheral wall 41. The ink supplying means supplies ink to the inner surface of the peripheral wall 41. Also, the printing drum 40 includes a rotation sensor and a position sensor (not shown in the drawings), with which the position in a rotational direction and the rotation speed are precisely controlled. A stencil printing machine capable of both perforating and printing, as disclosed in Japanese Provisional Patent Publication No. 96/48068, is applicable to perforating the stencil sheet in the embodiment. That is to say, after a perforated stencil sheet is wrapped around a printing drum of such conventional machine, the drum is detached from the machine and then installed in the present printing machine. Further, a single-purpose perforation machine is also applicable, by which a stencil sheet may be perforated, and then wrapped around the drum of the present printing machine.

As illustrated in FIGS. 3 and 4, an elevating section 43 is disposed to the frame 11 below the printing drum 40. The elevating section 43 comprises a vertically movable base 44 of approximately a box-shape and driving means 45 that drives the base 44 vertically. A press roller 46 is disposed on the upper-surface center of the base 44. The press roller 46 includes a horizontal axis perpendicular to the conveyance direction of the corrugated cardboard 2. The press roller 46 is located slightly in a printing-body introducing-side relative to the bottom of the printing drum 40. An axial length of the press roller 46 is arranged to be approximately identical to that of the printing drum 40 in the printing section 6. The press roller 46 includes no driving power connected thereto; the roller 46 is freely rotatable. The press roller 46 conveys a printing body by sandwiching it against the driven printing drum 40. In this way, stencil printing is conducted on the corrugated cardboard.

As illustrated in FIGS. 3 and 4, on the upper surface side of the base 44, a drive roller 47 is disposed in the printing body introducing-side relative to the press roller 46. The drive roller 47 is parallel to the press roller 46 and longer than the roller 46. The base 44 includes driving means 48 which is connected to the drive roller 47 through a one-way clutch. During printing, the one-way clutch functions; thus, the drive roller 47 can be driven to rotate by the movement of the corrugated cardboard 2. The drive roller 47 functions as a supporting roller for supporting the corrugated cardboard 2 to be movable in the conveying direction.

As illustrated in FIGS. 3 and 4, on the upper surface side of the base 44, an idle roller 50 is disposed in a printing body discharging-side relative to the press roller 46. The idle roller 50 is parallel to the press roller 46 and longer than the roller 46. The distance between the idle roller 50 and the press roller 46 is the same as that between the drive roller 47 and the press roller 46. The idle roller 50 is freely rotatable. The idle roller 50 functions as a supporting roller for supporting the corrugated cardboard 2 to be movable in the conveying direction.

As illustrated in FIG. 4, a positioning sensor 51 is disposed on the base 44. The positioning sensor 51 is disposed on the axis of the press roller 46, thereby detecting the leading end of the conveyed corrugated cardboard 2 reaching the press roller 46.

As illustrated in FIG. 3, an idle roller 52 is disposed above the drive roller 47 to be parallel to each other. The idle roller 52 is freely rotatable. Also, the idle roller 52 is vertically movable. The idle roller 52 is arranged in the lowest position by the self-weight except when the corrugated cardboard is in contact with the roller. Namely, inserting the corrugated cardboard 2 between the idle roller 52 and the drive roller 47 raises the idle roller 52, and the self-weight holds the cardboard 2 against the drive roller 47. The corrugated cardboard 2 is conveyed by the first conveying section 5, and then positioned by the positioning means 33. After that the corrugated cardboard 2 is further conveyed while being sandwiched between the drive roller 47 and the idle roller 52. And the leading end of the corrugated cardboard 2 finally reaches the top of the press roller 46.

Figure 11:
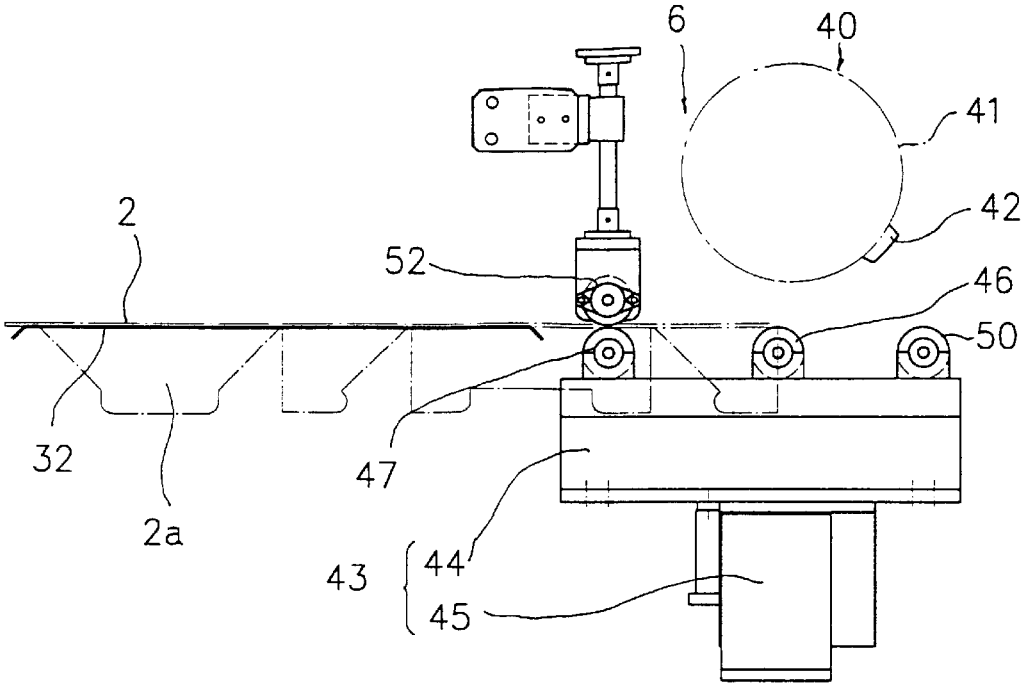
FIG. 11 is a view illustrating stencil printing on cardboard in a printing section of one embodiment according to the present invention.
Figure 12:
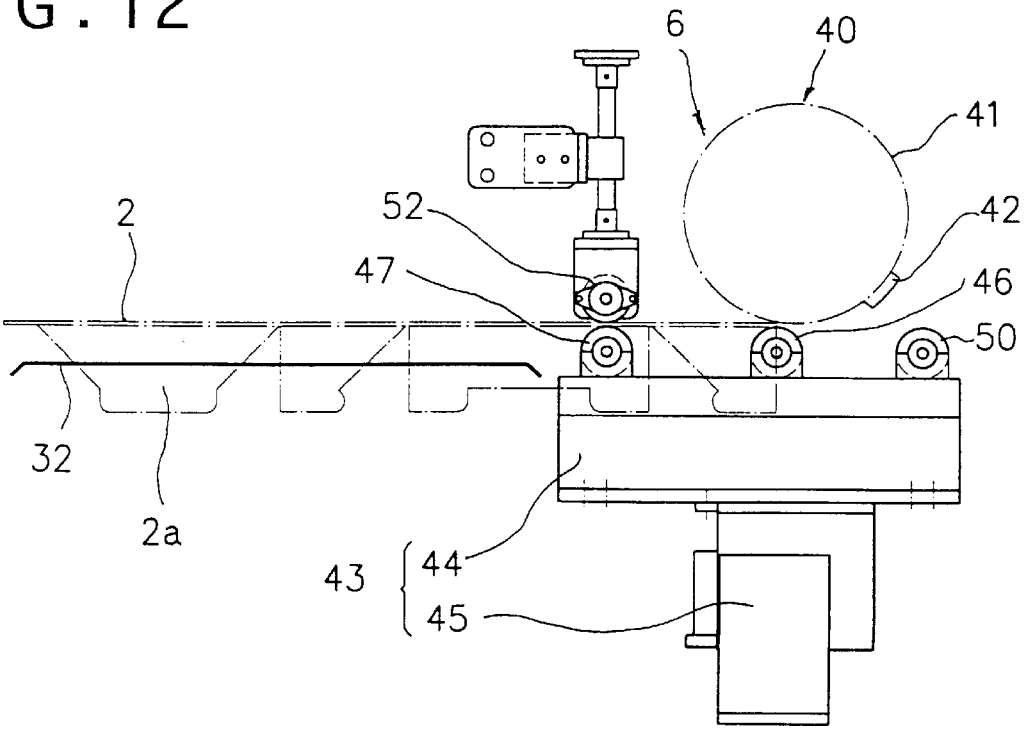
FIG. 12 is a view illustrating stencil printing on cardboard in a printing section of one embodiment according to the present invention.

As illustrated in FIGS. 11–12, when the driving means 45 functions in the elevating section 43, the base 44 moves vertically. The top of the press roller 46 moves, along with the vertical movement of the base 44, between the conveyance surface 32 as illustrated in FIG. 11 and the position where the corrugated cardboard 2 is held against the printing drum 40 as illustrated in FIG. 12. As illustrated in FIG. 12, the corrugated cardboard 2 that is held between the press roller 46 and the printing drum 40 is lifted from the conveyance surface 32.

As illustrated in FIG. 3, adjusting means 53 is disposed to the frame 11 for adjusting the vertical position of the entire elevating section 43. Driving the adjusting means 53 moves the vertical movement section 43. By adjusting the vertical position of the section 43, a pressure on the corrugated cardboard 2 exerted by the press roller 46 and printing drum 40 is properly adjusted.

Referring to FIGS. 11–18, stencil printing on the corrugated cardboard 2 in the printing section 6 will be explained. In the present embodiment, two identical images are to be printed on two portions of the corrugated cardboard 2.

As illustrated in FIG. 11, the corrugated cardboard 2, after being conveyed by the first conveying section 5 and positioned by the positioning means 33, is sandwiched between the drive roller 47 and the idle roller 52, thereby advancing so that its leading end reaches the top of the press roller 46. The positioning sensor 51 of the base 44 detects the leading end of the corrugated cardboard 2. A detecting signal from the positioning sensor 51 starts the printing section 6 operating.

As illustrated in FIG. 12, the base 44 ascends. The corrugated cardboard 2 is lifted, while being clamped between the drive roller 47 and the idle roller 52, from the conveyance surface 32. The leading end of the corrugated cardboard 2 is sandwiched between the press roller 46 and the printing drum 40. Before that, the printing drum 40 is arranged in a rotational printing-start position. Then, the printing drum 40 rotates anticlockwise in FIG. 12. The corrugated cardboard 2 is conveyed right while being sandwiched between the printing drum 40 and the press roller 46, thereby receiving a first printed-image on its first half portion.

Figure 13:
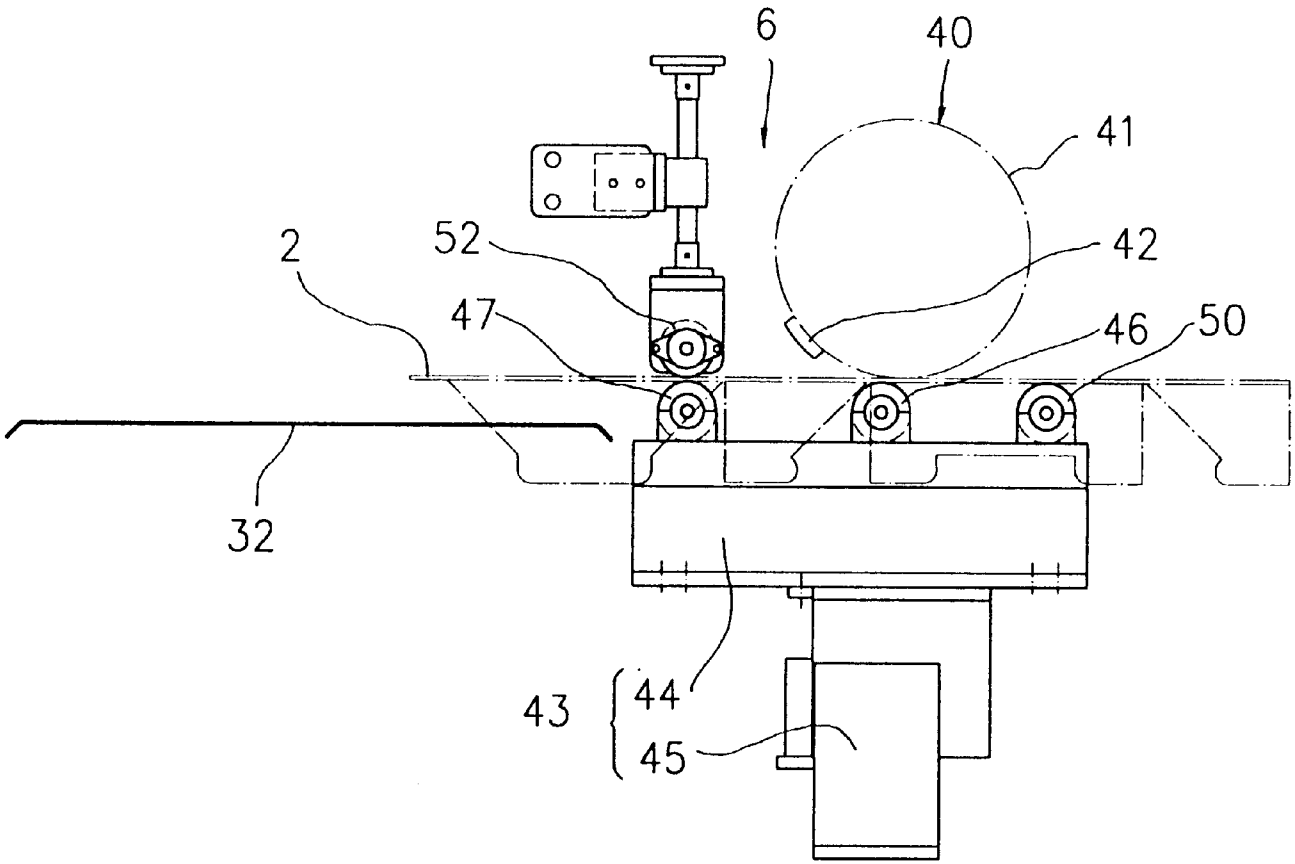
FIG. 13 is a view illustrating stencil printing on cardboard in a printing section of one embodiment according to the present invention.
Figure 14:
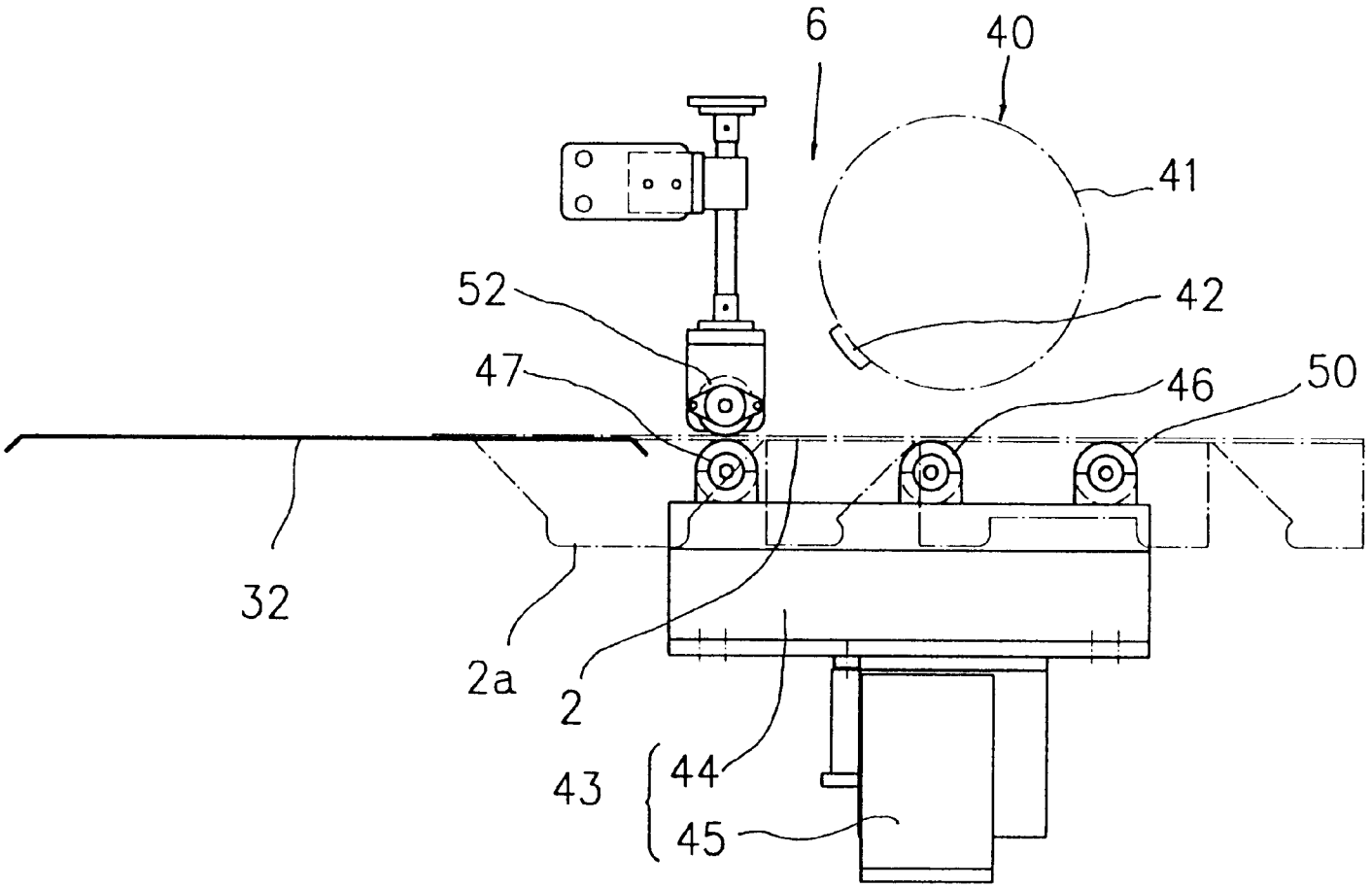
FIG. 14 is a view illustrating stencil printing on cardboard in a printing section of one embodiment according to the present invention.

FIG. 13 illustrates completion of the first printing. As illustrated in FIG. 14, the base 44 descends. The corrugated cardboard 2 is lowered to the height of the conveyance surface 32 while being clamped between the drive roller 47 and the idle roller 52. The corrugated cardboard 2 departs from the printing drum 40.

Figure 15:
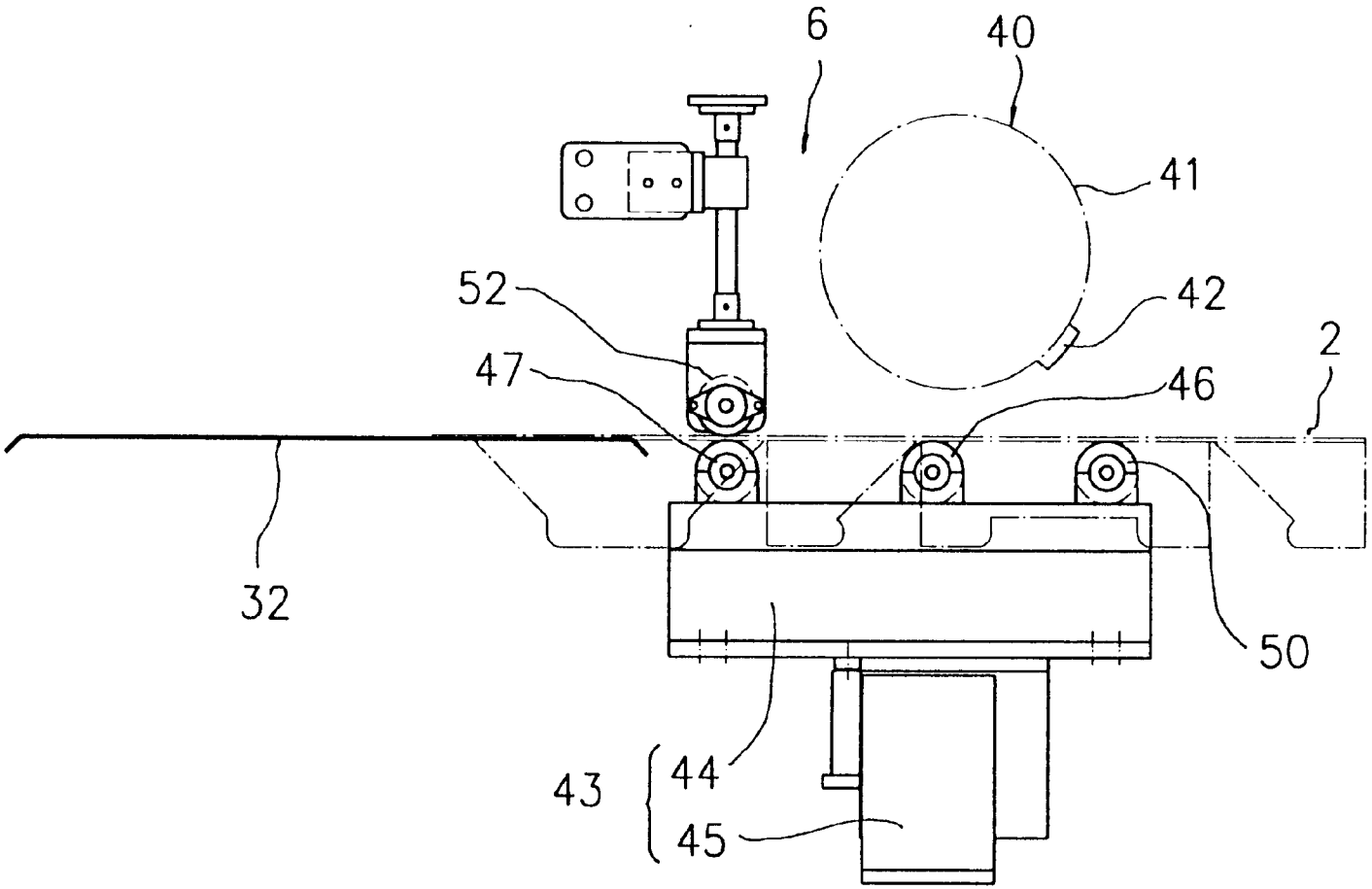
FIG. 15 is a view illustrating stencil printing on cardboard in a printing section of one embodiment according to the present invention.

The printing drum 40 rotates anticlockwise approximately in a right angle, thereby being arranged in a position illustrated in FIG. 15. This position is identical to the rotational printing-start position for the first printing as illustrated in FIG. 12.

Figure 16:
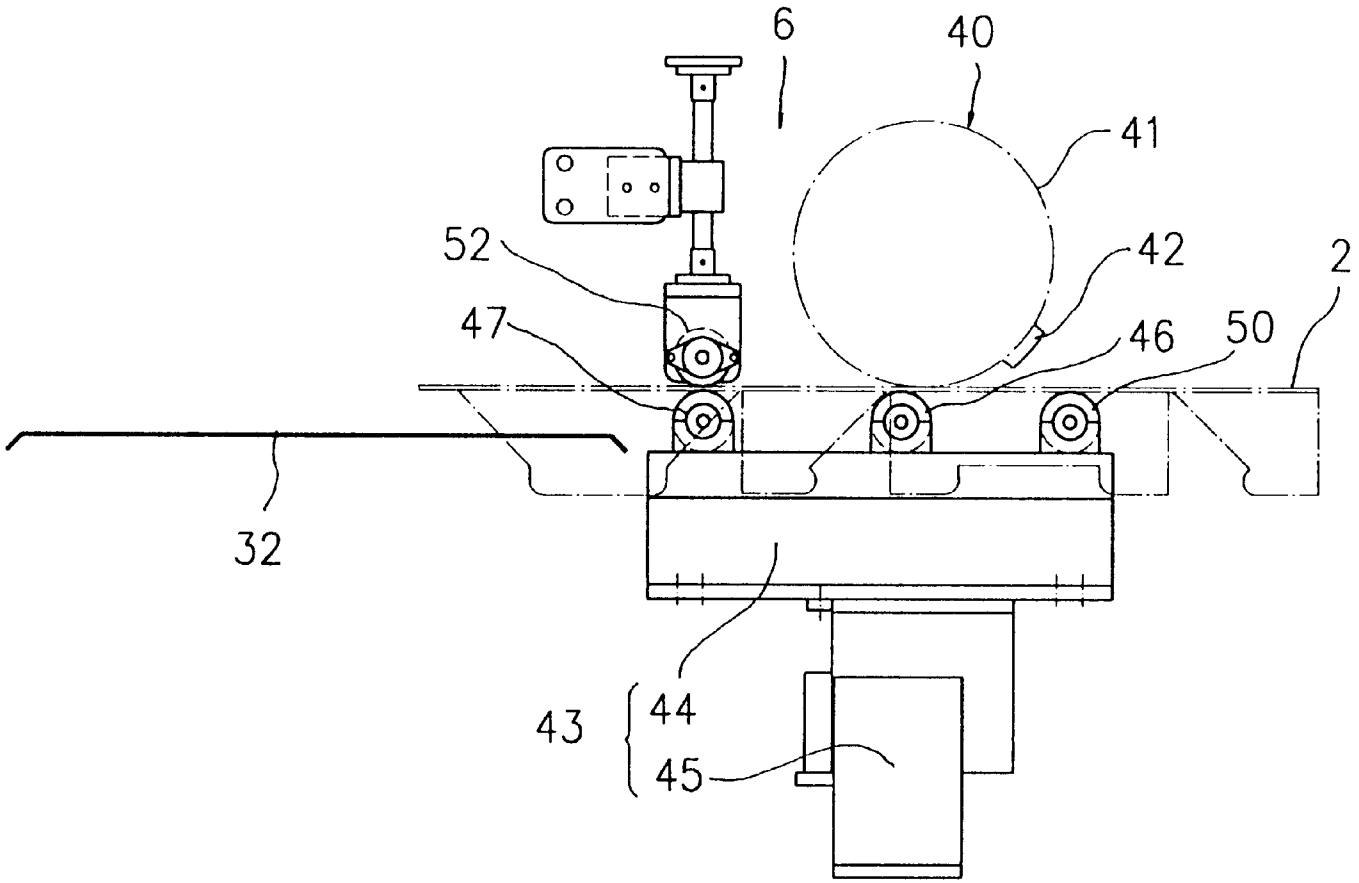
FIG. 16 is a view illustrating stencil printing on cardboard in a printing section of one embodiment according to the present invention.
Figure 17:
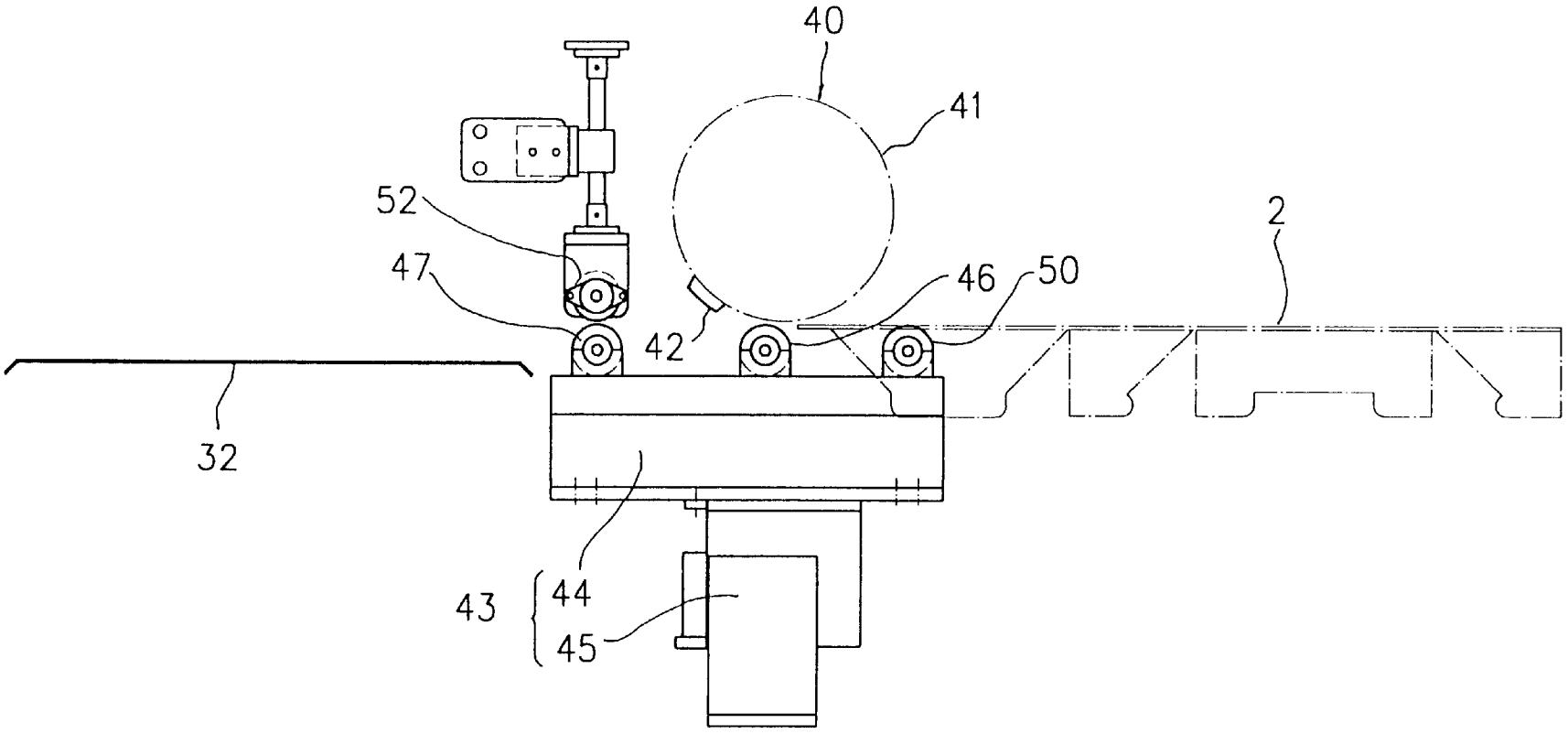
FIG. 17 is a view illustrating stencil printing on cardboard in a printing section of one embodiment according to the present invention.

As illustrated in FIG. 16, the base 44 ascends. The corrugated cardboard 2 is lifted, while being sandwiched between the drive roller 47 and the idle roller 52, from the conveyance surface 32. An approximately center portion of the corrugated cardboard 2 is sandwiched between the press roller 46 and the printing drum 40. Afterwards, the printing drum 40 rotates anticlockwise in FIG. 16. As illustrated in FIG. 17, the corrugated cardboard 2 is conveyed right while being sandwiched between the printing drum 40 and the press roller 46, thereby receiving a second printed-image on its second half portion.

Figure 18:
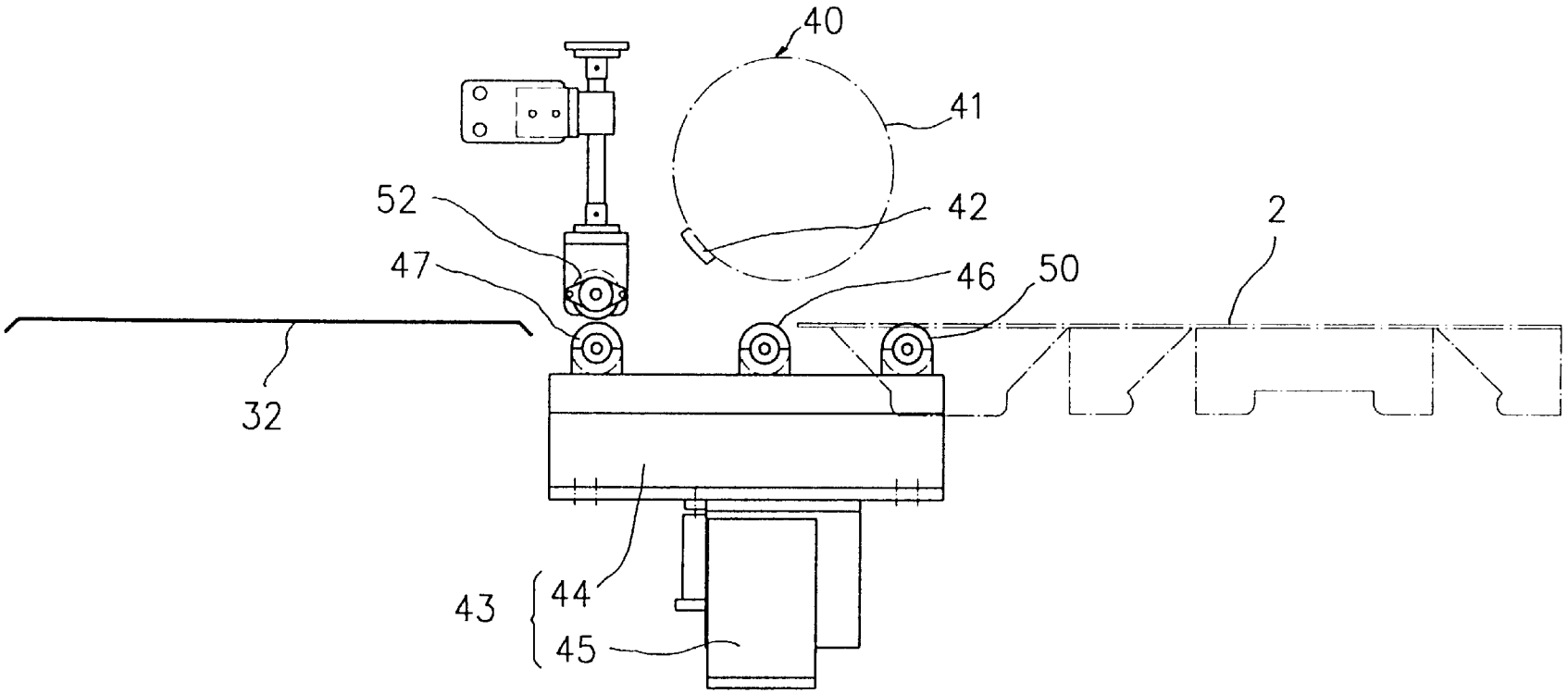
FIG. 18 is a view illustrating stencil printing on cardboard in a printing section of one embodiment according to the present invention.

As illustrated in FIG. 18, the base 44 descends; consequently, the corrugated cardboard 2 departs from the printing drum 40. In this way, identical stencil-printing image is twice formed on the single corrugated cardboard 2.

(4) Second Conveying Section 7

Figure 19:
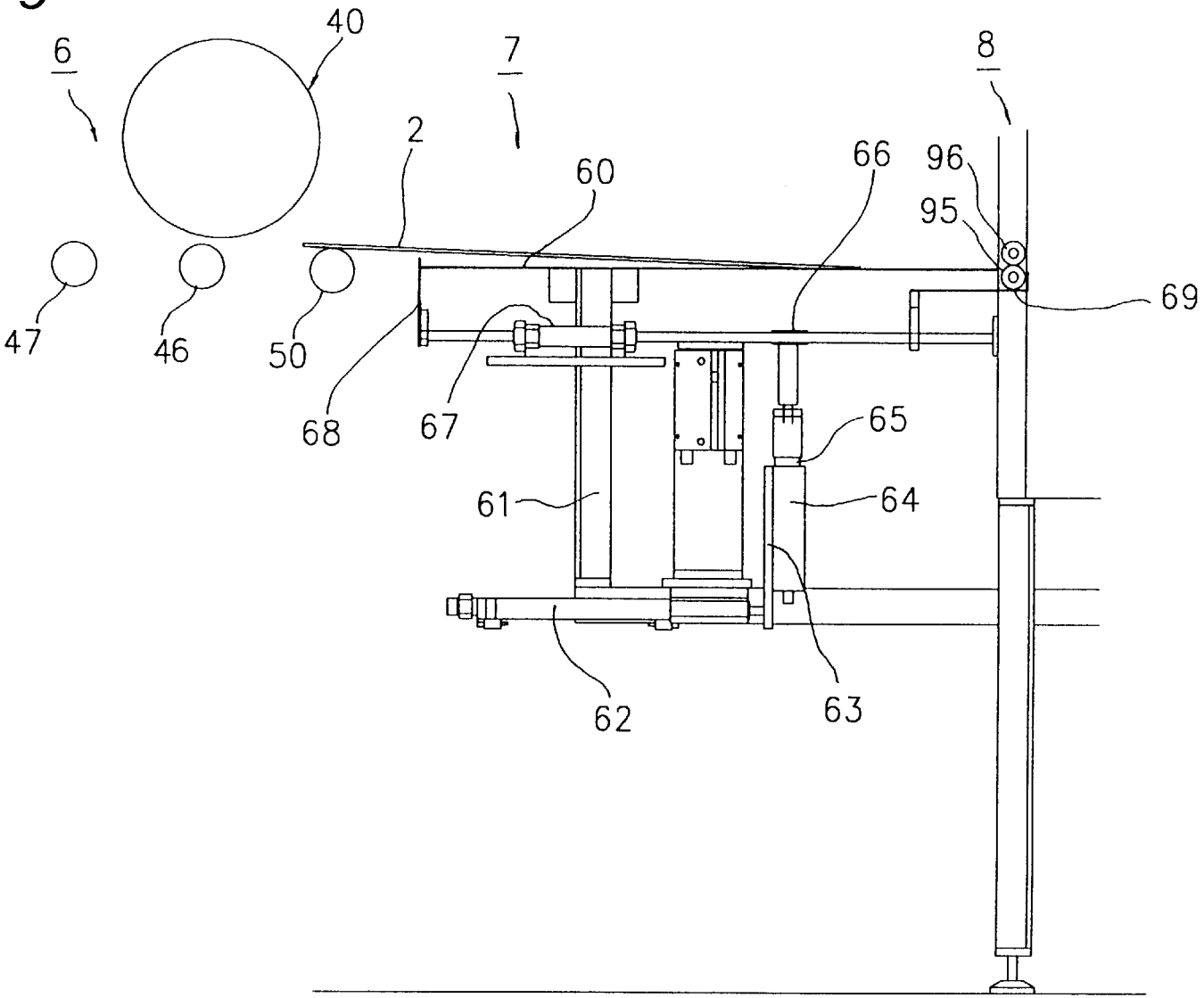
FIG. 19 is a view illustrating a constitution of a second conveying section and conveyance of cardboard in one embodiment according to the present invention.

As illustrated in FIG. 19, the second conveying section 7 is located next to the printing section 6 in the conveyance direction of the corrugated cardboard 2. The second conveying section 7 conveys the corrugated cardboard 2 received from the printing section 6 toward the drying section 8. The second conveying section 7 is attached to an entry side of the drying section 8.

As illustrated in FIG. 19, the second conveying section 7 includes a conveyance surface 60 for conveying the corrugated cardboard 2. The conveyance surface 60 is a flat and smooth plane. The surface 60 is disposed to a frame 61 that is fixed to the adjacent drying section 8. The conveyance surface 60 is arranged in a lower height than that of the corrugated cardboard 2 discharged from the printing section 6; therefore, the printed corrugated cardboard 2 can be received there smoothly without excessive impact.

As illustrated in FIG. 19, an air cylinder 62 as driving means is horizontally fixed to the frame 61 beneath approximately the center of the conveyance surface 60. A rod of the air cylinder 62 is oriented towards the drying section 8. On the rod-end of the air cylinder 62, a mounting plate 63 is disposed. The plate 63 is guided by a pair of horizontal guiding rails fixed to the frame 61. When the air cylinder 62 is operated, the mounting plate 63 reciprocates in the conveyance direction of the corrugated cardboard 2. On the mounting plate 63, an air cylinder 64 is vertically disposed. A rod of the air cylinder 64 is oriented vertically upwards. On the rod-end of the air cylinder 64, a base plate 65 is fixed. On the base plate 65, a pair of holding means 66, 66 are disposed. Two vacuum-suction cups function as the holding means 66, 66 in the present embodiment. When the air cylinder 64 on the mounting plate 63 is operated, the base plate 65 and the holding means 66 vertically reciprocate. The holding means reciprocates between the lower position and the higher position than the conveyance surface 60.

As illustrated in FIG. 19, an air cylinder 67 as driving means is horizontally fixed to the frame 61 beneath approximately the center of the conveyance surface 60. The air cylinder 67 is a double acting cylinder. A rod of the air cylinder 67 is parallel to the conveyance direction of the corrugated cardboard 2. On the rod-end of the air cylinder 67(printing section side), a first claw 68 is disposed for pushing a tailing end of the corrugated cardboard 2. In approximately the center of the conveyance surface 60, a groove is formed parallel to the conveyance direction of the corrugated cardboard 2. The first claw 68 is protruding through the groove over the conveyance surface 60. By operating the air cylinder 67, the first claw 68 is moved along the groove in the conveyance surface 60. On the other rod-end of the air cylinder 67(drying section side), a second claw 69 is disposed for pushing out the corrugated cardboard 2 in the drying section 8. When the air cylinder is operated, the second claw 69 reciprocates in the drying section 8 between an entry-side position and an exit-side position distant therefrom.

As illustrated in FIGS. 20–23, flap pushing means 70 is disposed in a predetermined position outside the conveyance surface 60. The flap pushing means 70 includes an air cylinder 71 disposed upward and a pushing plate 72 disposed horizontally on the rod-end of the cylinder 71. In the case where the corrugated cardboard 2 is large to some extent, the flap 2*a* on one side of the corrugated cardboard 2 is bent when being lifted by the fetching means 19. The flap pushing means 70 pushes up the bent flap 2*a* to recover the form.

As illustrated in FIGS. 19–26, corrugated cardboard conveyance in the second conveying section 7 will be explained. As illustrated in FIG. 19, after being printed in the printing section 6, the corrugated cardboard 2 is discharged onto the conveyance surface 60 of the second conveying section 7. Then, the first and the second claws are located in printing-section side positions in the second conveying section 7. Namely, the first claw 68 is in the position most adjacent to the printing section 6; the second claw 69 is in the position most adjacent to the entry in the drying section 8. Further, the holding means 66 is located in a position most adjacent to the printing section 6. The corrugated cardboard 2 which is discharged on the conveyance surface 60 is supported near the trailing end by the first claw 68 and the idle roller 50 of the printing section 6. The corrugated cardboard 2 is not in a complete contact with the conveyance surface 60.

Figure 20:
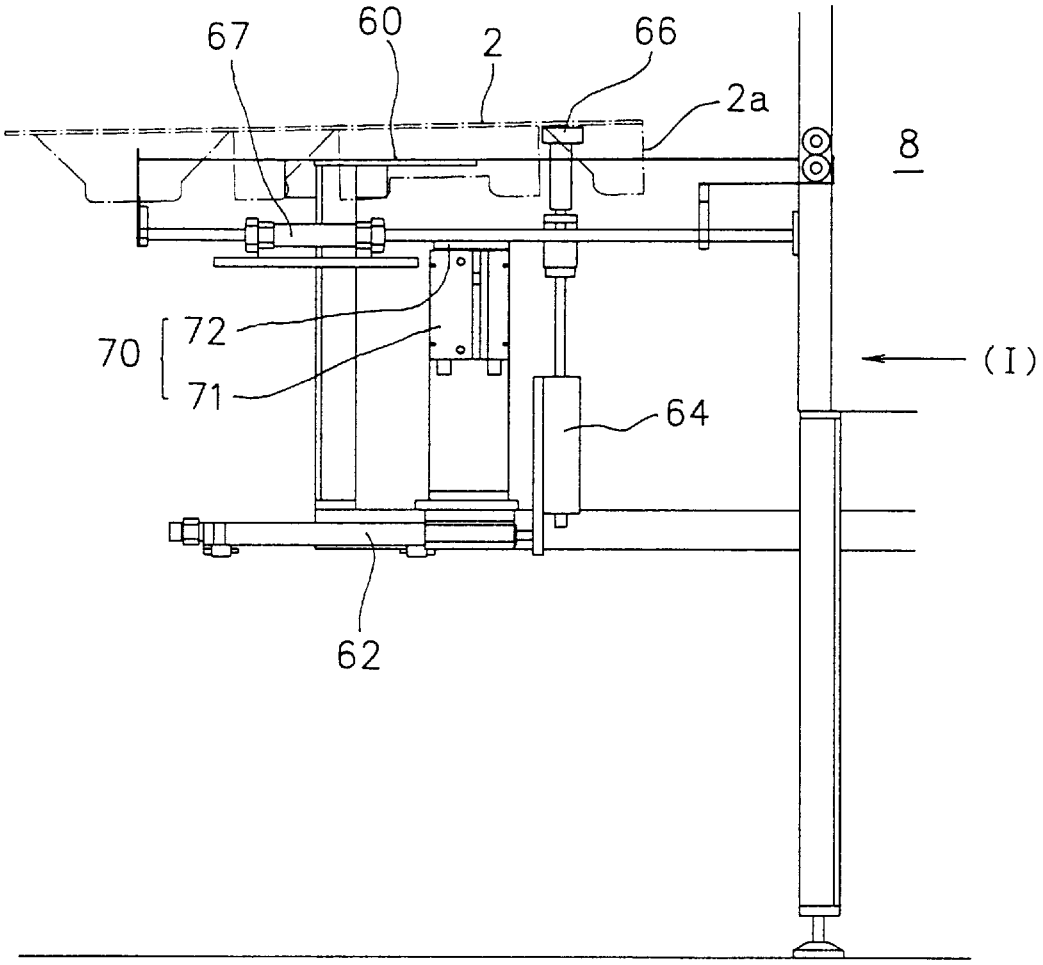
FIG. 20 is a view illustrating a constitution of a second conveying section and conveyance of cardboard in one embodiment according to the present invention.
Figure 21:
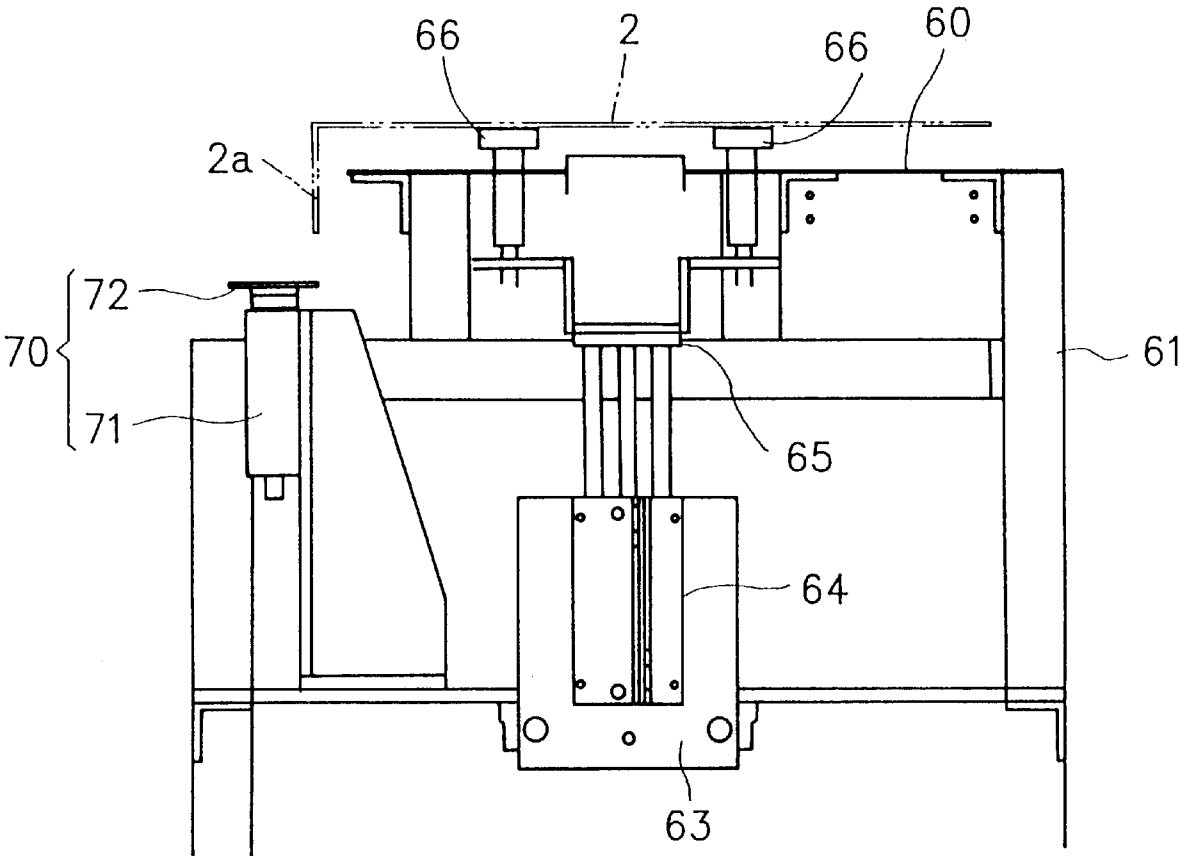
FIG. 21 is a view, taken in the direction of the arrow I of FIG. 20, illustrating a constitution of a second conveying section and conveyance of cardboard in one embodiment according to the present invention.

As illustrated in FIGS. 20 and 21, the air cylinder 64 is operated to move the holding means 66 upward over the conveyance surface 60. The holding means 60 sucks a leading-end bottom of corrugated cardboard and pushes up the portion over the conveyance surface 60. The corrugated cardboard 2 leans with the leading-end upward. Then, the flap 2*a* on the one side of the corrugated cardboard 2 remains as bent.

Figure 22:
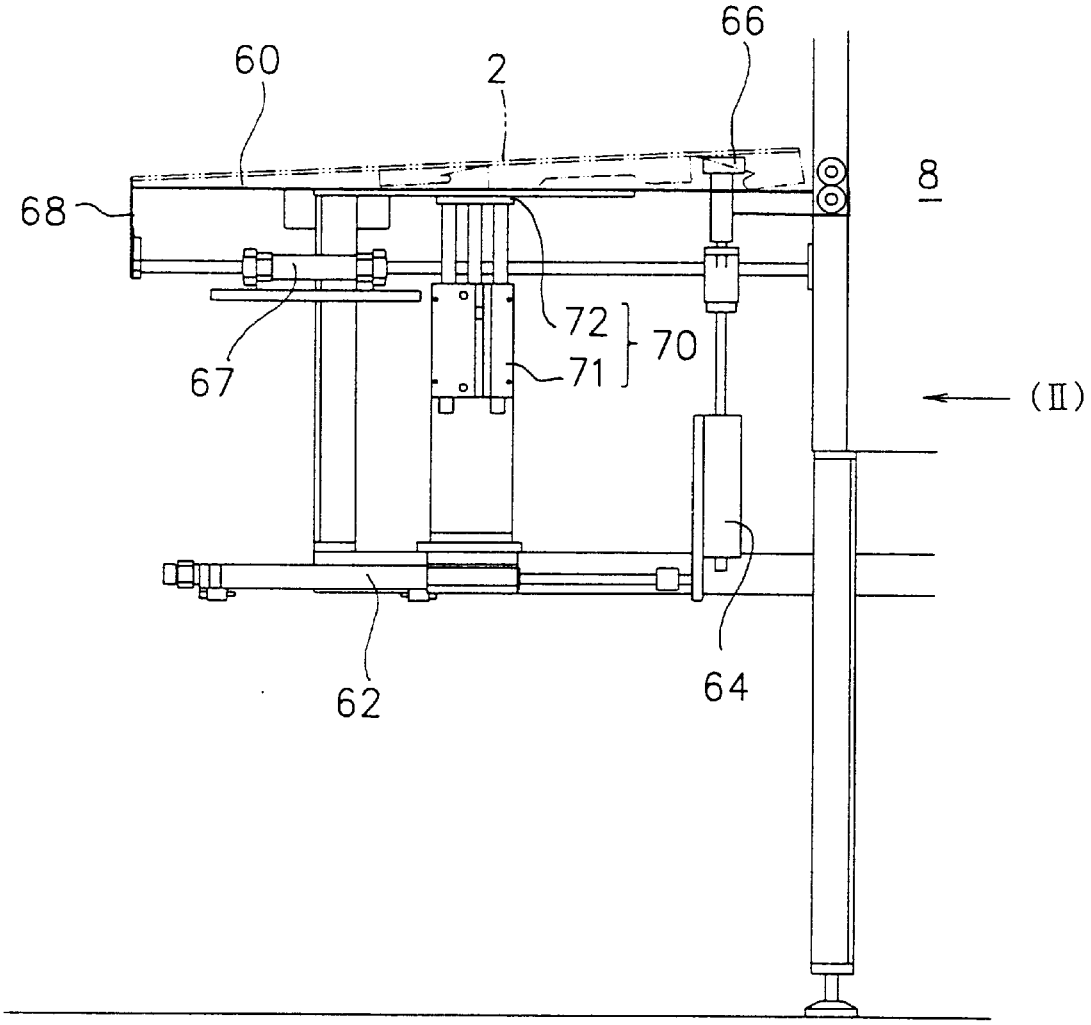
FIG. 22 is a view illustrating a constitution of a second conveying section and conveyance of cardboard in one embodiment according to the present invention.
Figure 23:
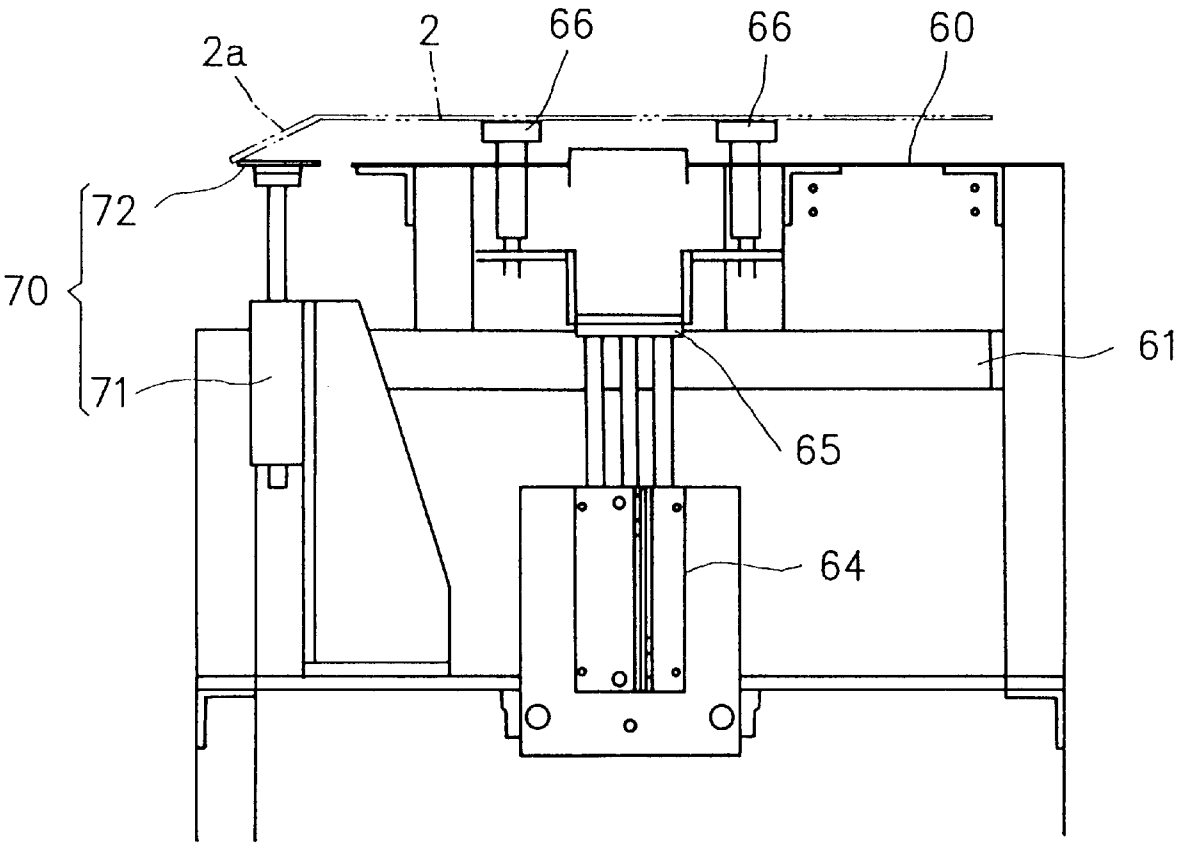
FIG. 23 is a view, taken in the direction of the arrow II of FIG. 22, illustrating a constitution of a second conveying section and conveyance of cardboard in one embodiment according to the present invention.

As illustrated in FIGS. 22 and 23, the air cylinder 62 is operated to move the holding means 66 toward the drying section 8. The holding means 60 that suck the corrugated cardboard bottom moves toward the drying section 8. The entire corrugated cardboard 2 enters the conveyance surface 60 after its tailing end crosses over the first claw 68. And then, the flap pushing means 70 pushes up the bent flap 2*a* to recover the form.

Figure 24:
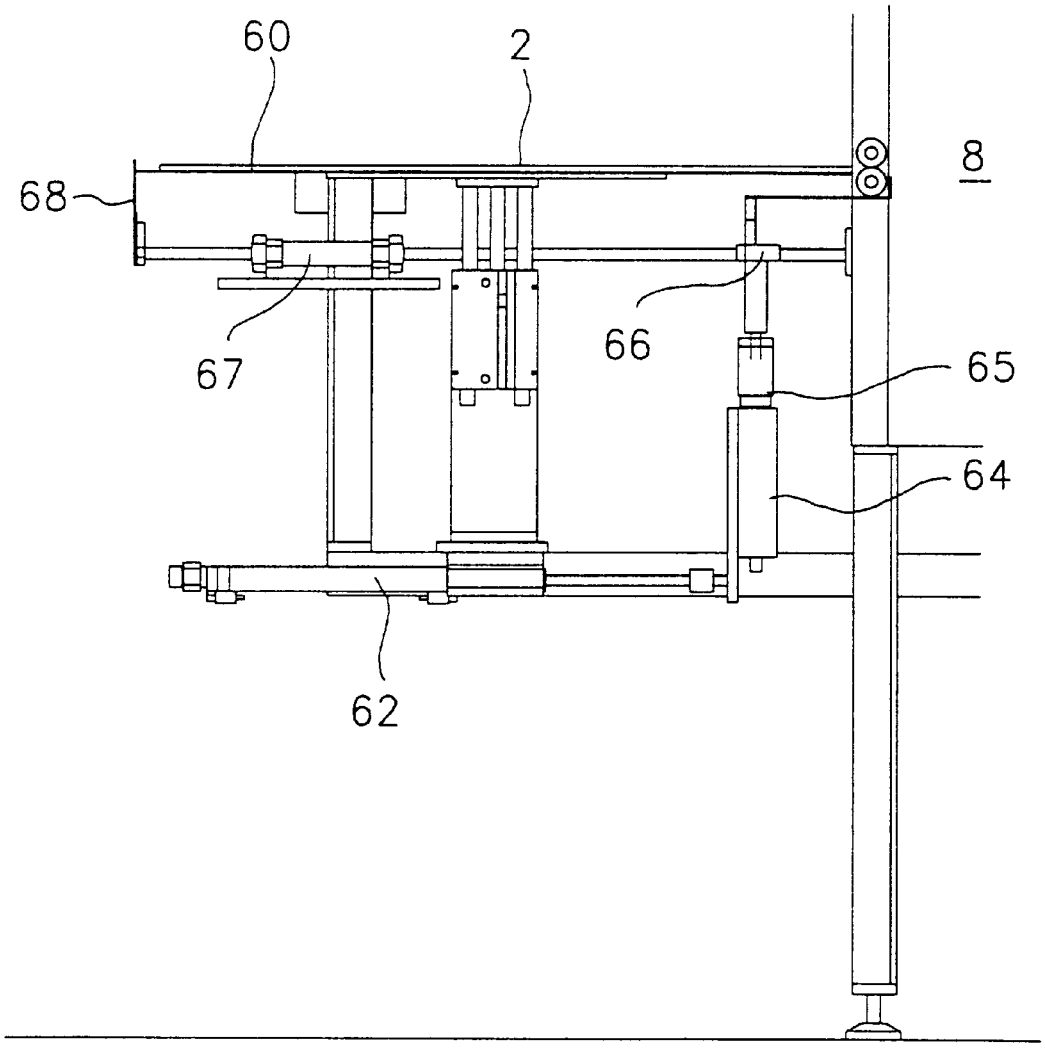
FIG. 24 is a view illustrating a constitution of a second conveying section and conveyance of cardboard in one embodiment according to the present invention.

As illustrated in FIG. 24, the air cylinder 64 is operated to lower the holding means 66 below the conveying surface 60, and then sucking by the holding means 66 is released. The corrugated cardboard 2 is placed on the conveying surface 60.

Figure 25:
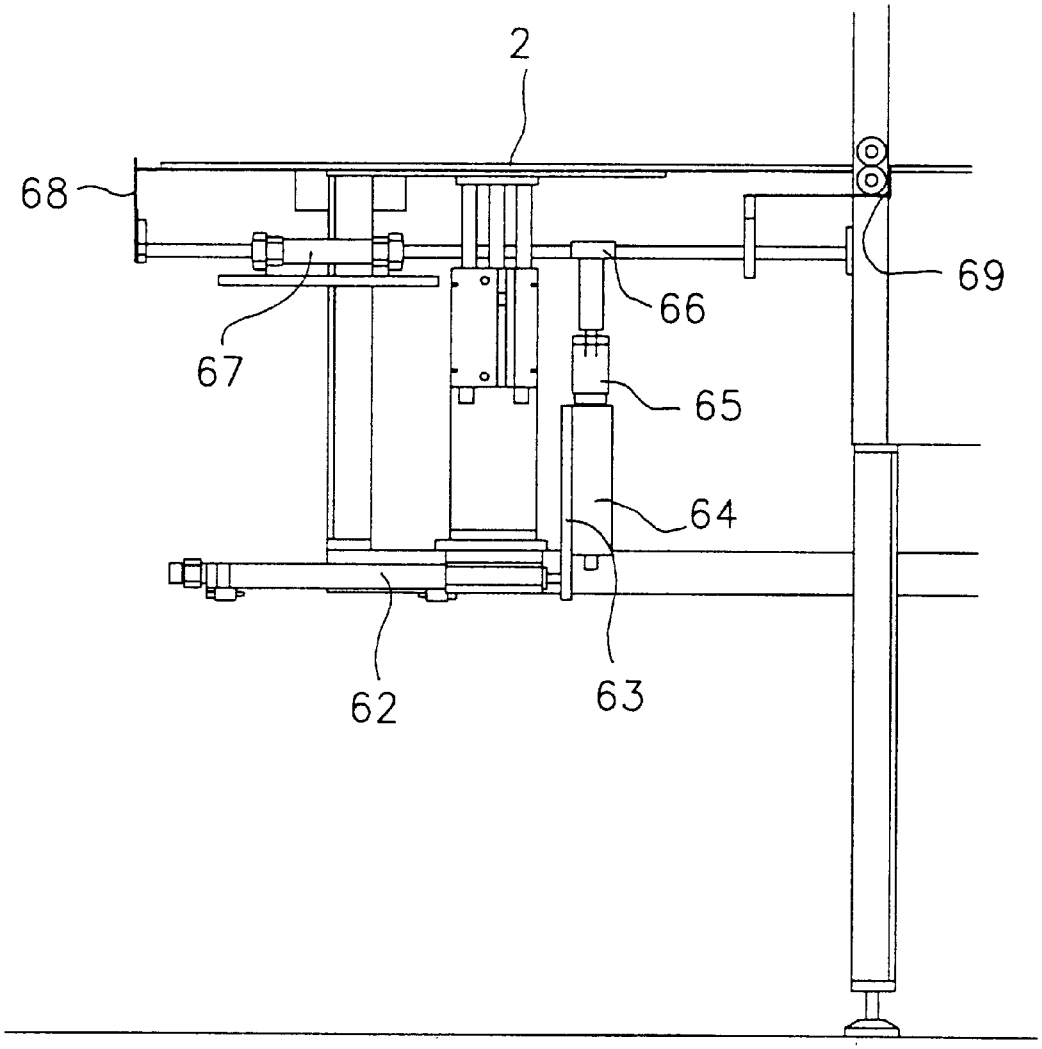
FIG. 25 is a view illustrating a constitution of a second conveying section and conveyance of cardboard in one embodiment according to the present invention.

As illustrated in FIG. 25, the air cylinder 62 is operated to restore the holding means 66 to the printing-section side (left in the drawing) position.

Figure 26:
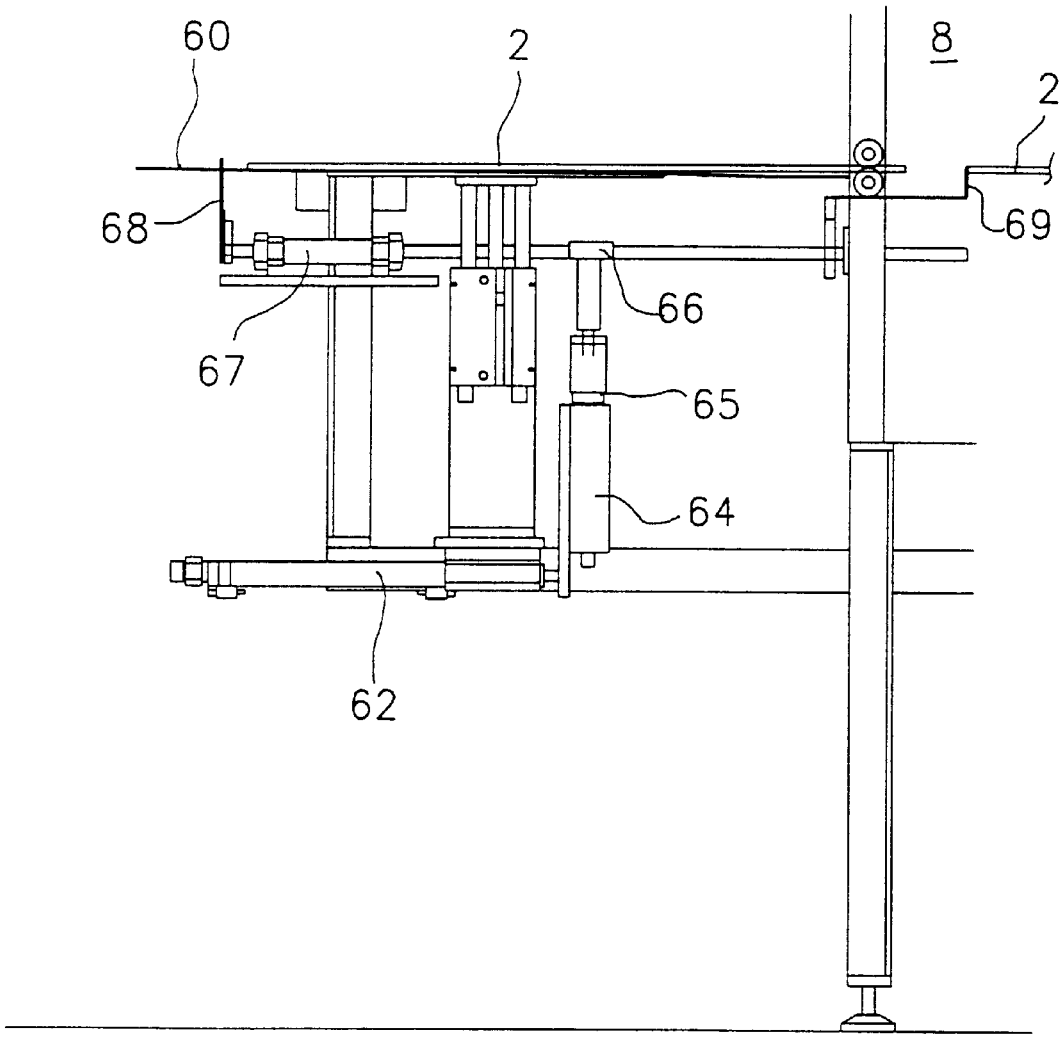
FIG. 26 is a view illustrating a constitution of a second conveying section and conveyance of cardboard in one embodiment according to the present invention.

As illustrated in FIG. 26, the air cylinder 67 is operated to move the first claw 68 toward the drying section 8. The first claw 68 pushes the tailing end of the corrugated cardboard 2. After the leading-end of the corrugated cardboard 2 enters the drying section 8, the corrugated cardboard 2 advances into the drying section 8. The second claw 69, which moves together with the first claw 68, pushes a former corrugated cardboard 2 in the drying section 8. The former corrugated cardboard 2 as being pushed is conveyed toward the exit of the drying section 8, and then discharged outside.

(5) Drying Section 8

Figure 27:
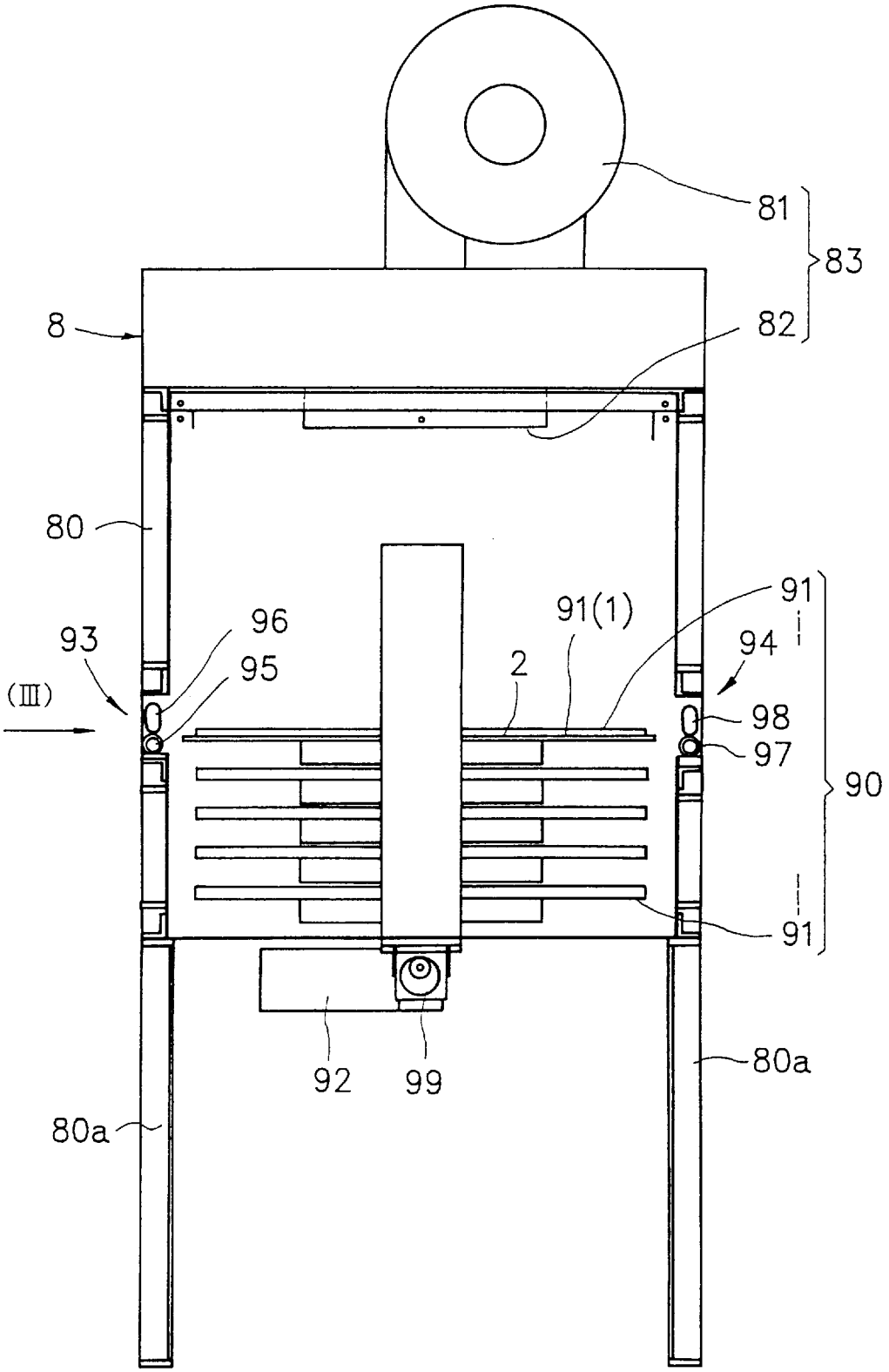
FIG. 27 is a view illustrating a constitution of a drying section and a drying operation of cardboard in one embodiment according to the present invention.

As illustrated in FIG. 27, the drying section 8 is located next to the second conveying section 7 in the conveyance direction of the corrugated cardboard 2. The drying section 8 receives the corrugated cardboard 2 conveyed by the second conveying section 7, and then dries the one as printed by hot air. The drying section 8 includes a casing 80 supported by legs 80*a*. On the upper of the casing 80, a hot air providing means 83 as heating means is disposed. The hot air providing means 83 comprises a blower 81 and a heater 82. Inside the casing 80, there is provided a temperature sensor. The hot air providing means 83 blows hot air into the casing 80. The hot-air temperature is controlled by controlling means. Output signal from the temperature sensor is received by the controlling means. Given a desired value in the controlling means, it keeps feedback-control of the temperature according to the signal from the temperature sensor. The inside of the casing 80 is kept at a temperature close to the desired value.

Figure 32:
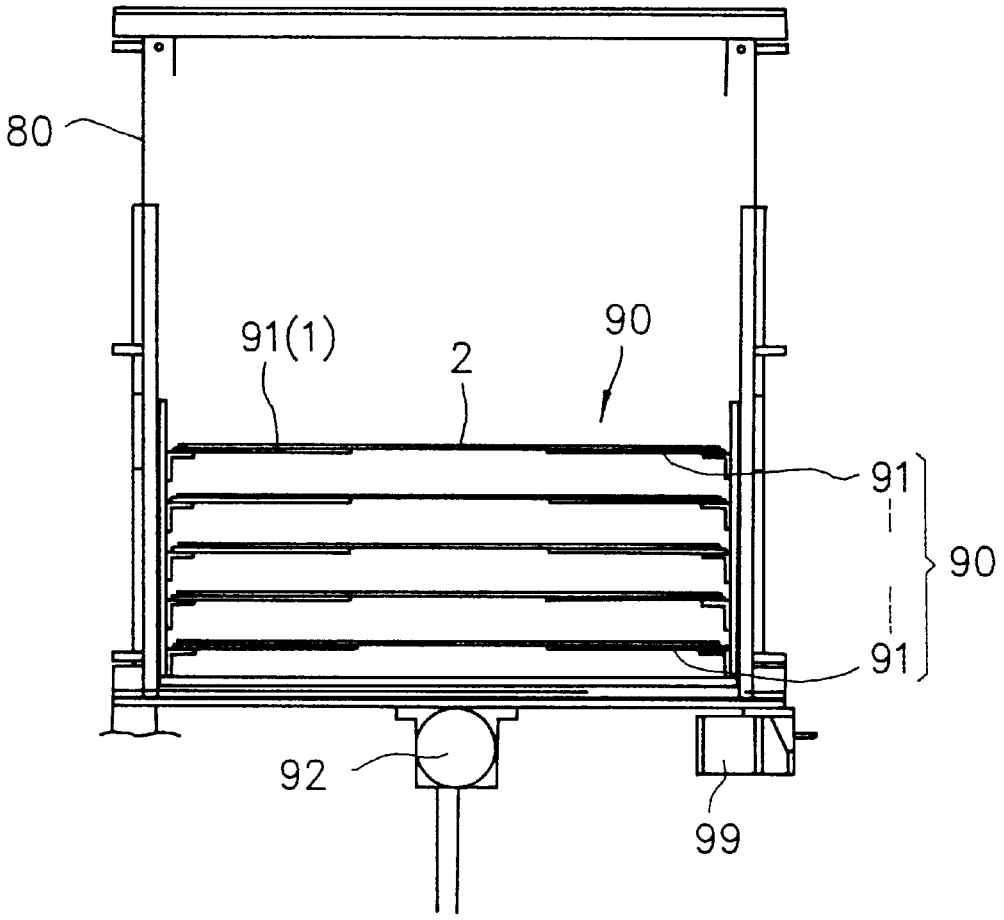
FIG. 32 is a view, taken in the direction of the arrow III of FIG. 27, illustrating a constitution of a drying section and a drying operation of cardboard in one embodiment according to the present invention.

As illustrated in FIG. 27 and 32, there is provided in the casing 80 a storage section 90 having a plurality of storage trays 91 (five storage trays included in the present embodiment). The storage trays 91 are arranged vertically at specific gaps. Each storage tray 91 is divided into two portions arranged on both sides of the conveyance direction. The entire storage section 90 vertically moves in the casing 80 by a vertical movement mechanism driven by a vertical movement motor 92. The storage section 90 can move within a vertical range corresponding to a height of the entire storage section 90. When the storage section 90 is positioned in the bottom, the top storage tray 91 is located in the level of the entrance 93 and the exit 94. When the storage section 90 is positioned in the top, the bottom storage tray 91 is located in the level of the entrance 93 and the exit 94.

A drive roller 95 and an idle roller 96 are disposed at the entrance 93 of the casing 80. The drive roller 95 and the idle roller 96 at the entrance 93 pull the corrugated cardboard 2 outside the casing 80 into the inside thereof. A drive roller 97 and an idle roller 98 are disposed at the exit 94 of the casing 80. The drive roller 97 and the idle roller 98 at the exit 94 convey the corrugated cardboard 2 from the casing 80 to the outside thereof. A single drive motor 99 commonly drives the idle rollers 95 and 97 to rotate.

As illustrated in FIGS. 27–32, a drying operation of the corrugated cardboard 2 in the drying section 8 will be explained. As shown in FIG. 27, the storage section 90 is placed in the bottom position in the drying section 8. The first corrugated cardboard 2, after being printed in the printing section 6, is pushed by the first claw 68 and enters the drying section 8 to be placed on the top storage tray 91(1).

Figure 28:
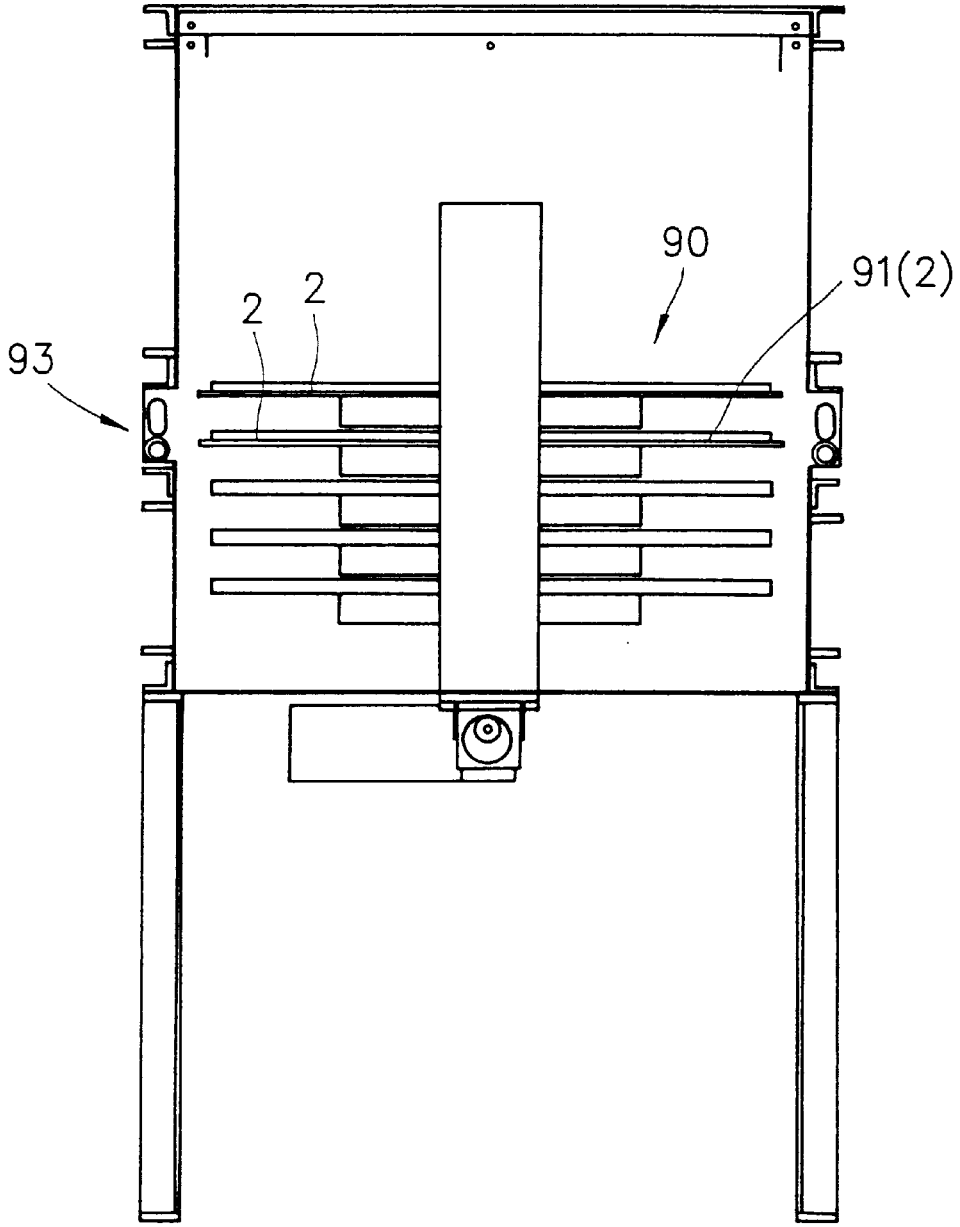
FIG. 28 is a view illustrating a constitution of a drying section and a drying operation of cardboard in one embodiment according to the present invention.

As illustrated in FIG. 28, when the storage section 90 ascends by one tray, the second-top storage tray 91 faces the entrance 93. The second corrugated cardboard 2, after being printed in the printing section 6, is pushed by the first claw 68 and enters the drying section 8 to be placed on the second-top storage tray 91(2).

Figure 29:
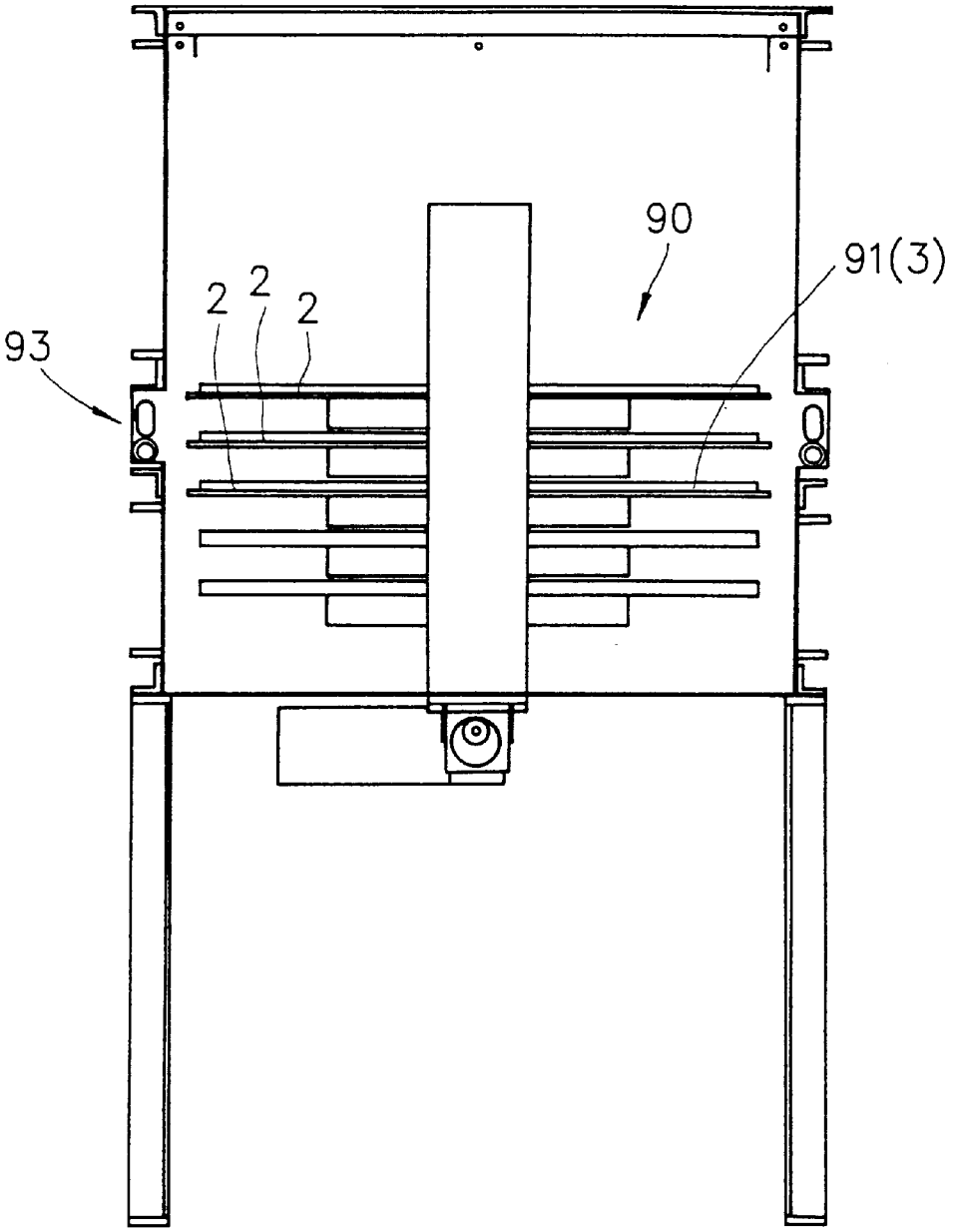
FIG. 29 is a view illustrating a constitution of a drying section and a drying operation of cardboard in one embodiment according to the present invention.

As illustrated in FIG. 29, when the storage section 90 ascends further by one tray, the third-top storage tray 91 faces the entrance 93. The third corrugated cardboard 2, after being printed in the printing section 6, is pushed by the first claw 68 of the first conveying section 7 and enters the drying section 8 to be placed on the third-top storage tray 91(3).

Figure 30:
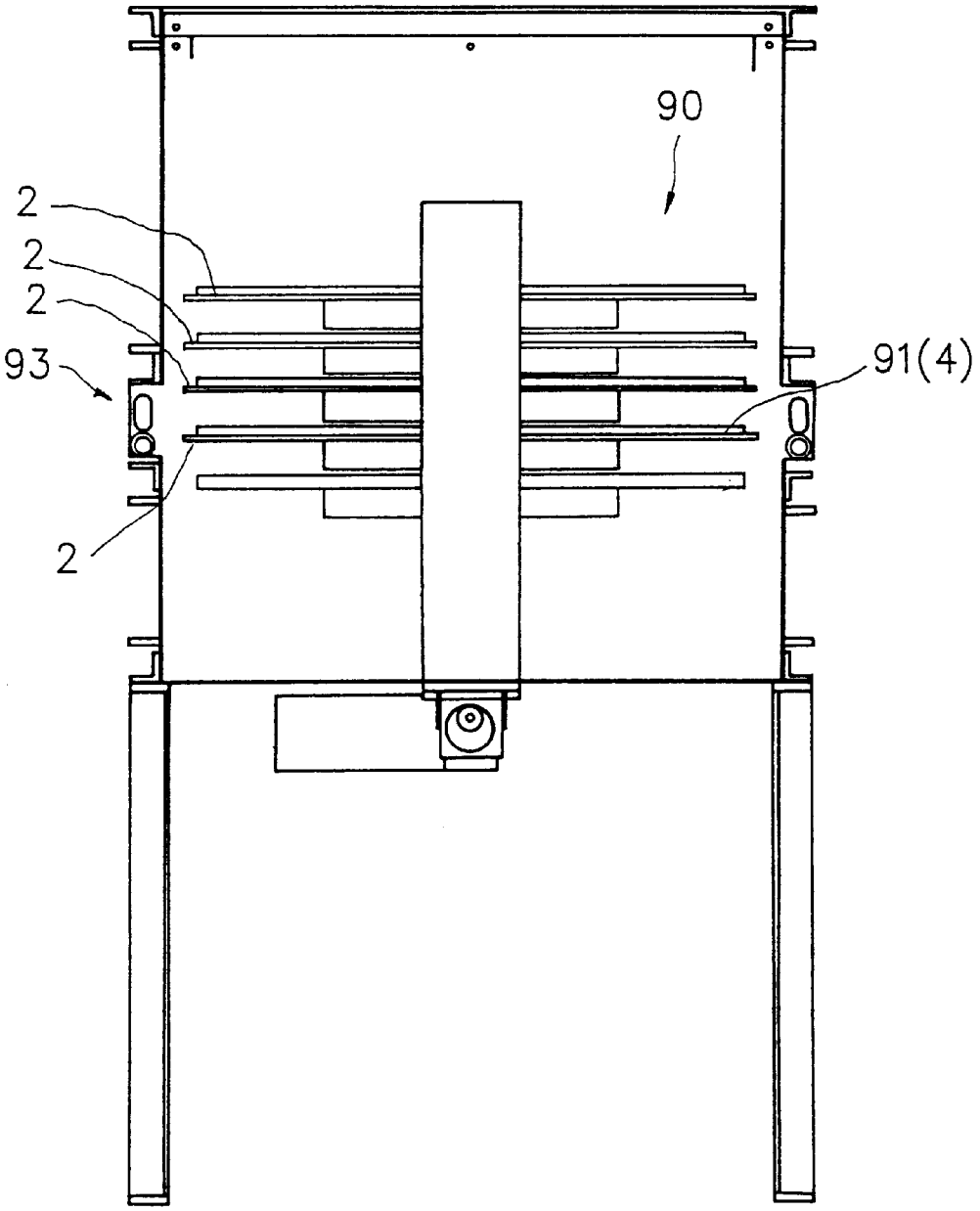
FIG. 30 is a view illustrating a constitution of a drying section and a drying operation of cardboard in one embodiment according to the present invention.

As illustrated in FIG. 30, when the storage section 90 ascends further by one tray, the fourth-top storage tray 91(4)

faces the entrance 93. The fourth corrugated cardboard 2, after being printed in the printing section 6, is pushed by the first claw 68 of the first conveying section 7 and enters the drying section 8 to be placed on the fourth-top storage tray 91(4).

Figure 31:
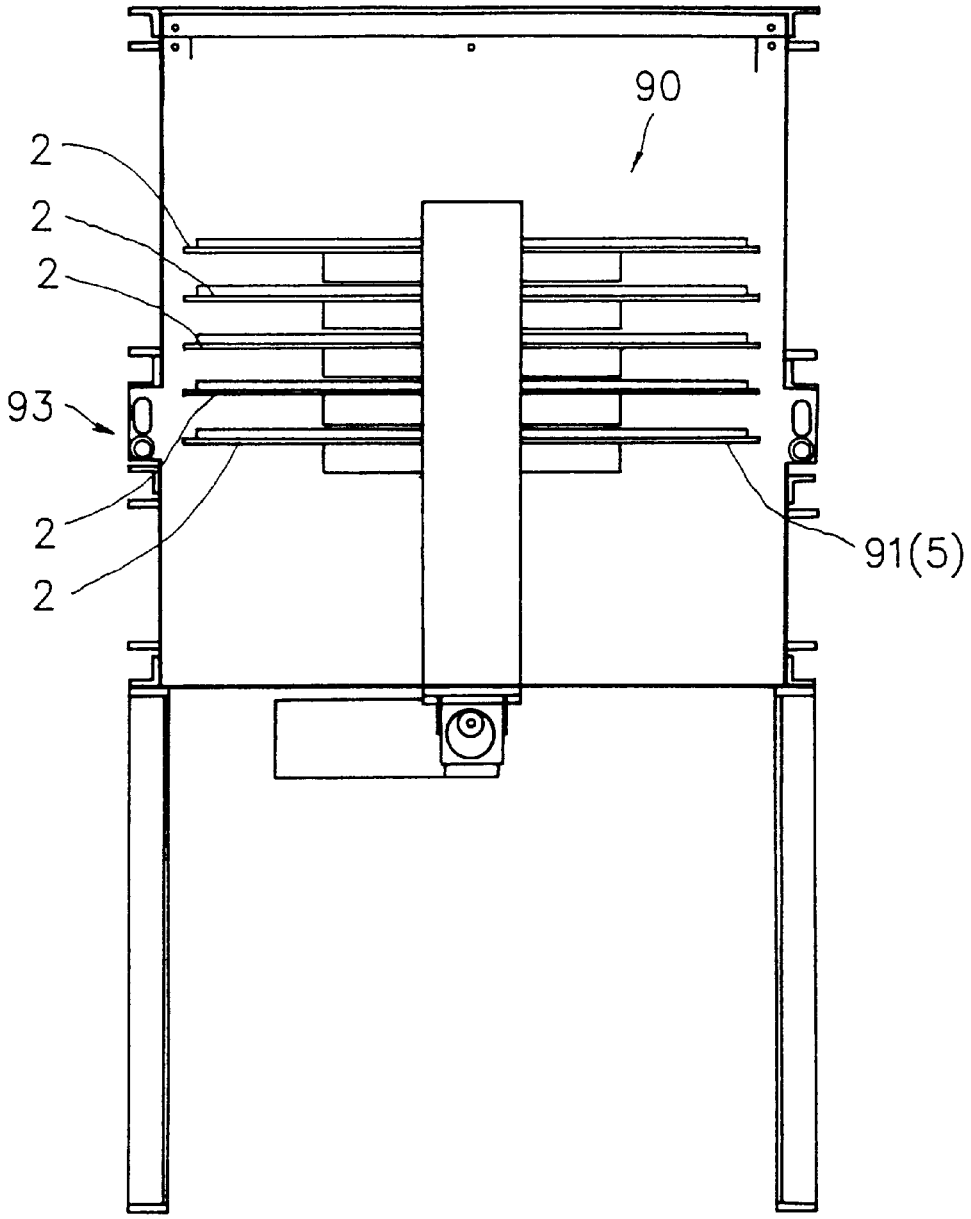
FIG. 31 is a view illustrating a constitution of a drying section and a drying operation of cardboard in one embodiment according to the present invention.

As illustrated in FIG. 31, when the storage section 90 ascends further by one tray, the bottom storage tray 91(5) faces the entrance 93. Namely, the storage section 90 is placed in the top position. The fifth corrugated cardboard 2, after being printed in the printing section 6, is pushed by the first claw 68 of the first conveying section 7 and enters the drying section 8 to be placed on the bottom storage tray 91(5).

After receiving the printed corrugated cardboard 2 in each of the five storage trays 91, the storage section 90 descends from the top to the bottom position. Then, the sixth corrugated cardboard 2 printed in the printing unit 6 is pushed by the first claw 68 of the second conveying section 7 to enter the drying section 8. The second claw 69, which is integrally formed with the first claw 68 and moves in the same direction as the first claw, pushes the first corrugated cardboard 2 on the top storage tray 91(1) toward the exit 94. After being pushed, the first corrugated cardboard 2 is conveyed to the outside of the casing 80 while being sandwiched by the drive roller 97 and the idle roller 98. Meanwhile, the printed ink on the first corrugated cardboard 2 is dried. At the same time, the sixth corrugated cardboard 2 as printed is received in the top storage tray 91(1).

Similarly, as the storage section 90 descends by one tray, the subsequent printed corrugated cardboard 2 is conveyed to and the previous corrugated cardboard 2 as dried is discharged from the drying section 8.

(6) Box Assembling Section 9

As illustrated in FIGS. 33–38, the box assembling section 9 is located next to the drying section 8 in the conveyance direction of the corrugated cardboard 2. The box assembling section 9 loops the printed corrugated cardboard 2, which is dried by and discharged from the drying section 8, by bonding both ends thereof so that a box can be assembled from the cardboard 2.

The assembling section 9 includes a rectangular frame 100. On the bottom of the frame 100, a conveyor belt 101 is disposed as conveying means for conveying the corrugated cardboard 2. An entry—side of the conveyor belt 101 faces the drive roller 97 and the idle roller 98 on the exit 94 of the drying section 8.

Figure 33:
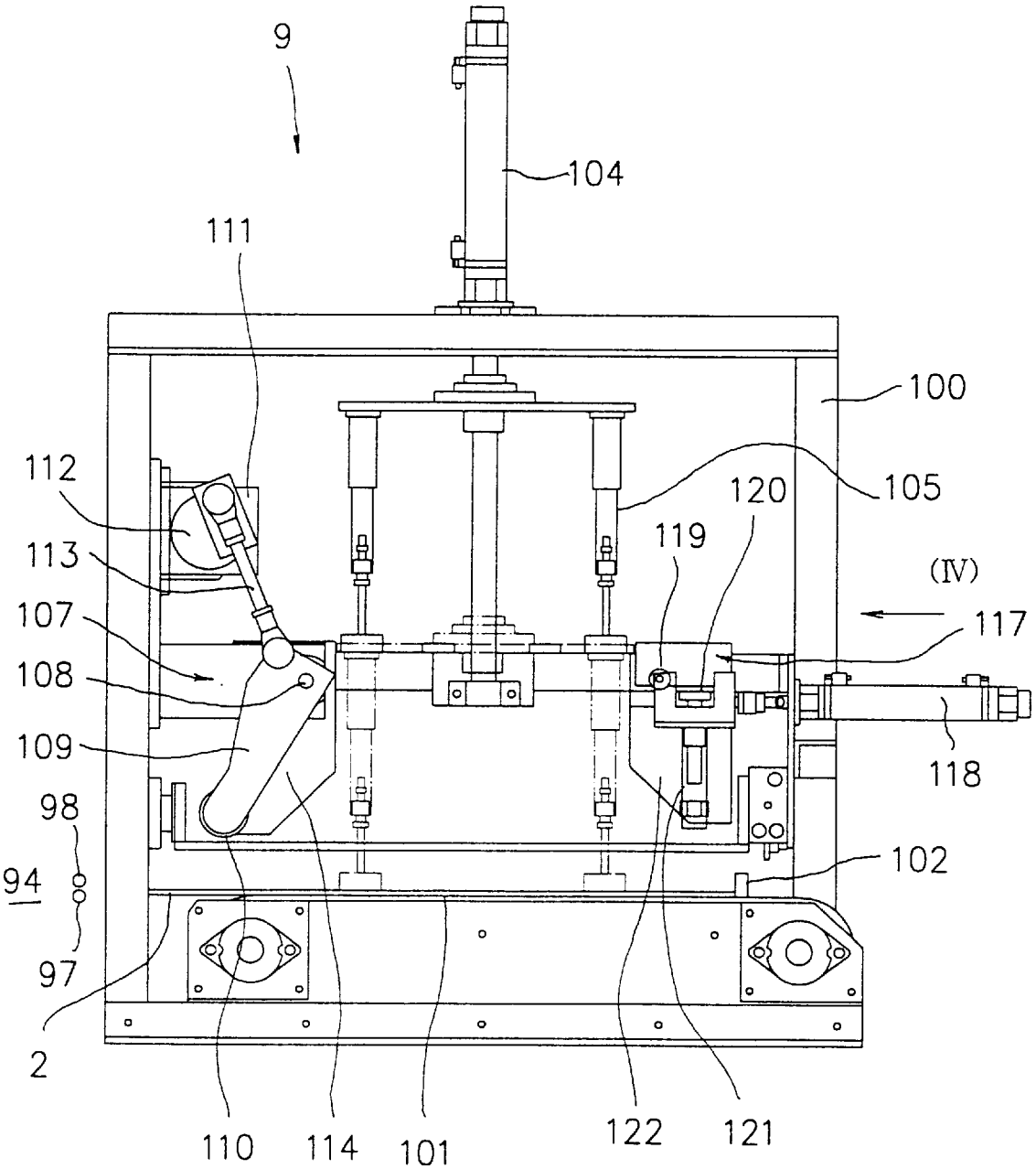
FIG. 33 is a view illustrating a constitution and an operation of a box-assembling section in one embodiment according to the present invention.

As illustrated in FIG. 33, a stopper 102 is disposed adjacent to a discharging-side of the conveyor belt 101. The stopper 102 is placed under the conveyor belt 101 carrying the corrugated cardboard 2; however, the stopper is capable of protruding over the belt 101 when required. The corrugated cardboard 2 can be positioned in the conveyance direction by halting the conveyor belt 101 just after the cardboard 2 meets the stopper 102 protruding over the belt 101.

Figure 38:
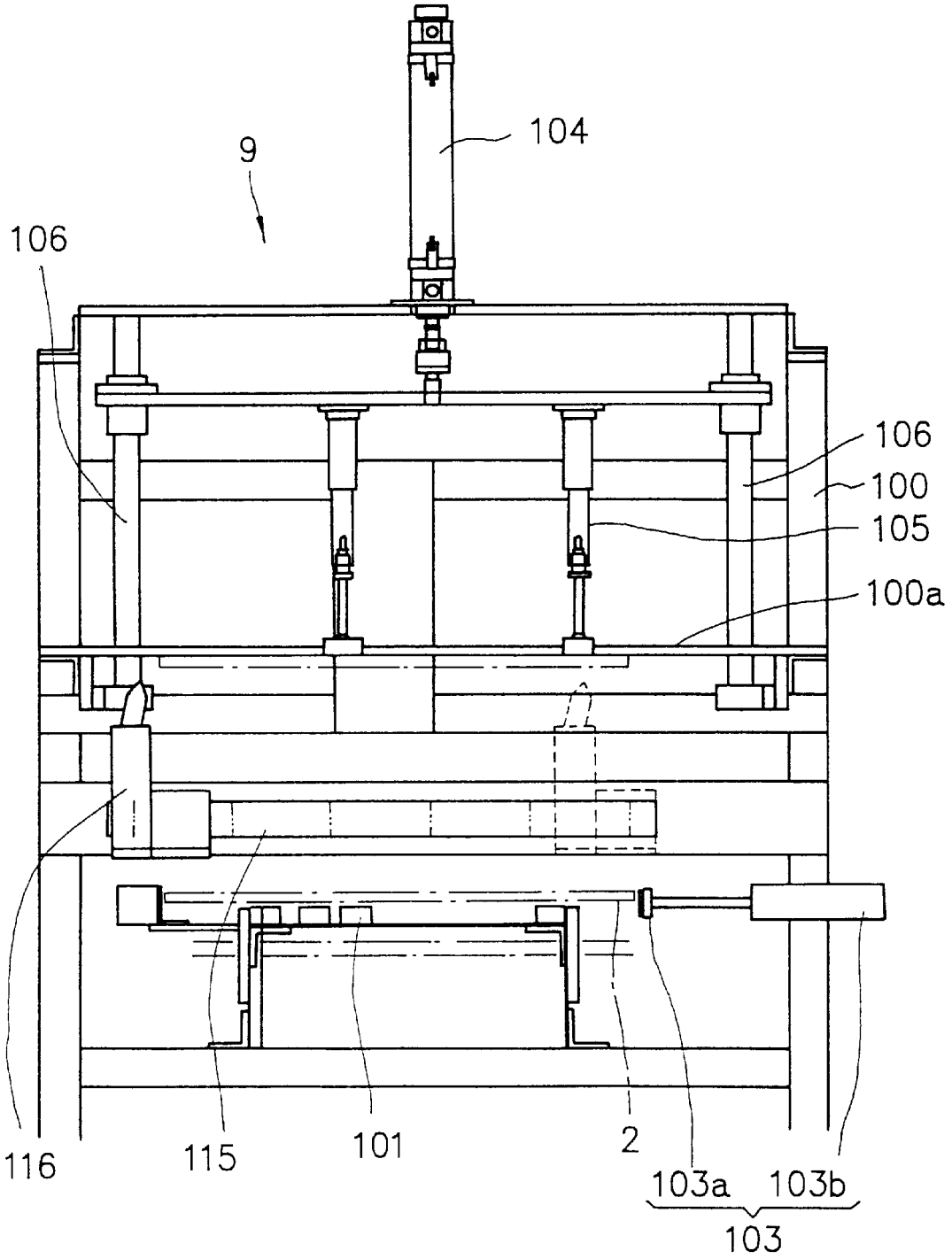
FIG. 38 is a view, taken in the direction of the arrow IV of FIG. 33, illustrating a constitution and an operation of a box-assembling section in one embodiment according to the present invention.

As illustrated in FIG. 38, cross-directional positioning means 103 is disposed in the frame 100. The cross-directional positioning means 103 includes a positioning member 103*a* and a press cylinder 103*b* disposed on one side of the frame. The cross-directional positioning means 103 can conduct a cross-directional positioning of the corrugated cardboard 2, i.e. the cardboard positioning in a direction perpendicular to the cardboard conveyance direction.

As illustrated in FIGS. 33 and 38, an air cylinder 104 as driving means is disposed downwards on approximately the center top of the frame 100. Holding means 105 is connected to the lower end of a rod of the air cylinder 104. The holding means 105 includes four vacuum-suction cups. The holding means 105 is supported by a vertical guiding means 106; therefore, the means 105 can move smoothly in the vertical direction by operating the air cylinder 104. The corrugated cardboard 2, after being located in a predetermined position on the conveyor belt 101, is held by the holding means 105 and then lifted up by the air cylinder 104.

As illustrated in FIG. 33, first folding means 107 for folding the corrugated cardboard 2 is disposed on the dring-section-8 side of the frame 100. In the frame 100, there is disposed an axis 108 which is perpendicular to the conveying direction of the corrugated cardboard 2; also arms 109, 109 are swingably disposed on the axis. Between the ends of the arms 109, 109, a first folding roller 110 is rotatably disposed. A motor 111 as driving means is attached to the drying-section-8 side of the frame 100. A driving shaft of the motor 111 is coaxially attached to a rotating disc 112. And, the arm 109 and the rotating disc 112 are linked together by a connecting arm 113 so as to move in synchronization. Namely, one end of the connecting arm 113 is eccentrically and pivotally connected to the rotating disc 112 of the motor 111, and the other end of the arm 113 is pivotally connected to a side portion of the arm 109. Rotating the disc 112 by driving the motor 111 makes the arm 109 swing. Further, a pair of first guide plates 114 is attached to the frame 100, between which plates the arms 109, 109 connected by the first folding roller 110 are disposed.

As illustrated in FIG. 38, a guide rail 115 is disposed adjacent to the discharging side of the frame 100. The guide rail 115 is perpendicular to the conveying direction of the corrugated cardboard 2. On the guide rail 115, adhesive supplying means 116 is movably disposed. The adhesive supplying means 116 is such that it provides an adhesive to a predetermined position of the corrugated cardboard 2 lifted by the holding means 105.

As illustrated in FIG. 33, second folding means 117 for folding the corrugated cardboard 2 is disposed on the discharging side of the frame 100. Also, on the discharging side of the frame 100, an air cylinder 118 as driving means is disposed. Along the conveying direction of the corrugated cardboard 2, the air cylinder 118 is directed in the opposite direction to that toward the drying section 8. On a rod-end of the air cylinder 118, there is disposed a second folding roller 119, a press plate 120 and an air cylinder 121. The air cylinder 121 is directed vertically upward. On a rod-end of the air cylinder, the press plate 120 is disposed. By operating the two air cylinders 118, 121, the press plate 120 can be pushed up in a predetermined position. Further, a pair of second guide plates 122, 122 is attached to the frame 100, between which plates the second folding roller 119 is disposed.

Referring to FIGS. 33–38, an explanation will be made to an operation of bonding the corrugated cardboard in the box assembling section 9. As illustrated in FIG. 33, the corrugated cardboard 2 is discharged by the drive roller 97 and the idle roller 98 both disposed at the exit 94 of the drying section 8, and then the cardboard 2 enters the box assembling section 9. The corrugated cardboard 2 is conveyed by the conveyor belt 101 of the box assembling section 9. When the corrugated cardboard 2 meets the stopper 102 protruding over the belt 101, the conveyer belt 101 halts. The cross-directional positioning means 103 functions to adjust the cross-directional position of the corrugated cardboard 2, thereby positioning the cardboard 2 to a home position.

As illustrated in imaginary lines in FIG. 33, the holding means 105 is moved downward by operating the air cylinder 104, thereby holding the upper surface of the corrugated cardboard 2 by vacuum suction.

Figure 34:
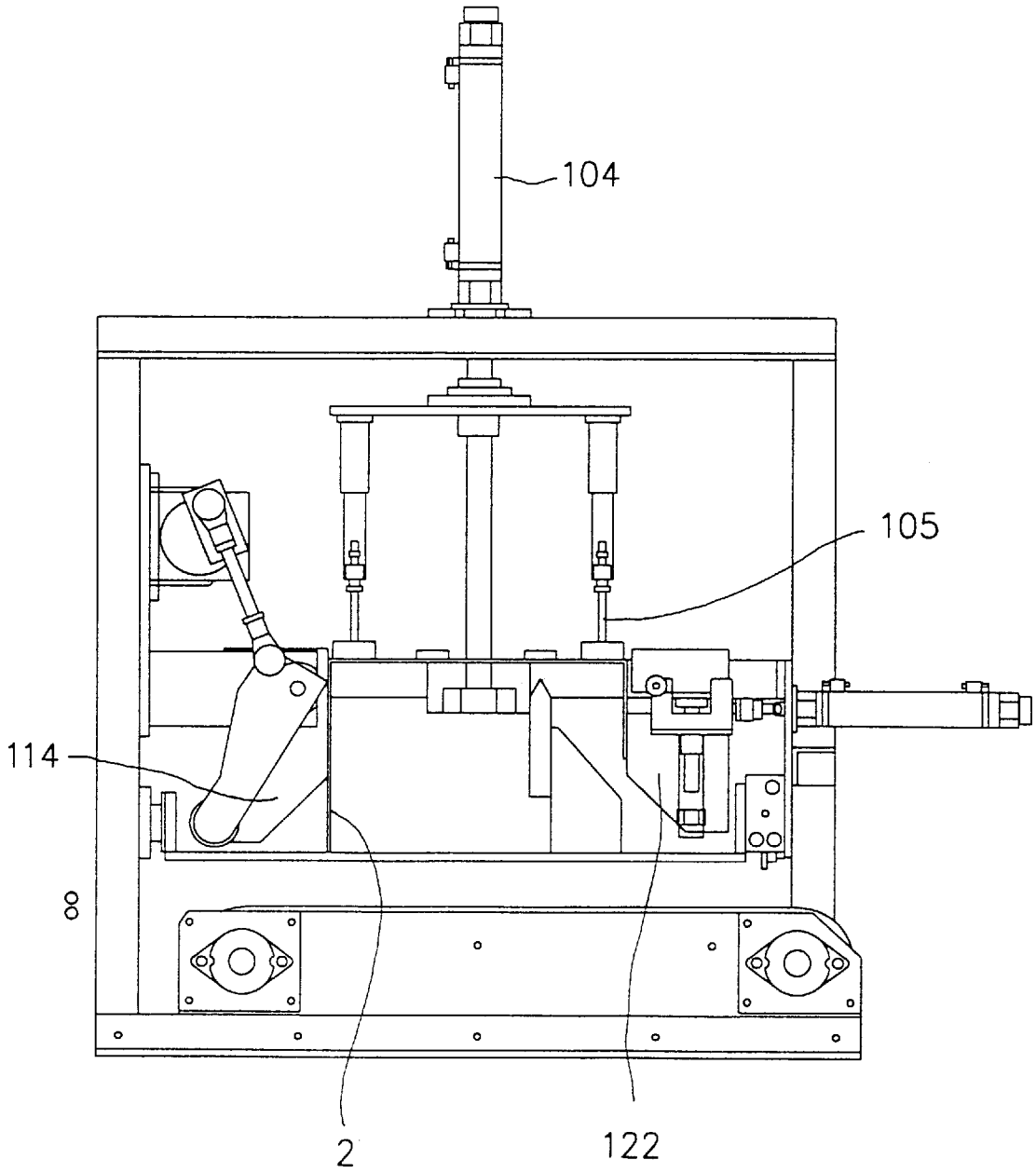
FIG. 34 is a view illustrating a constitution and an operation of a box-assembling section in one embodiment according to the present invention.

As illustrated in FIG. 34, the holding means 105 is moved upward by operating the air cylinder 104. The corrugated cardboard 2 is lifted up to enter between the first guide plate 114 and the second guide plate 122. The front and rear portions of the corrugated cardboard 2 are bent downward while being pushed by the first guide plate 114 and the second guide plate 122.

Figure 35:
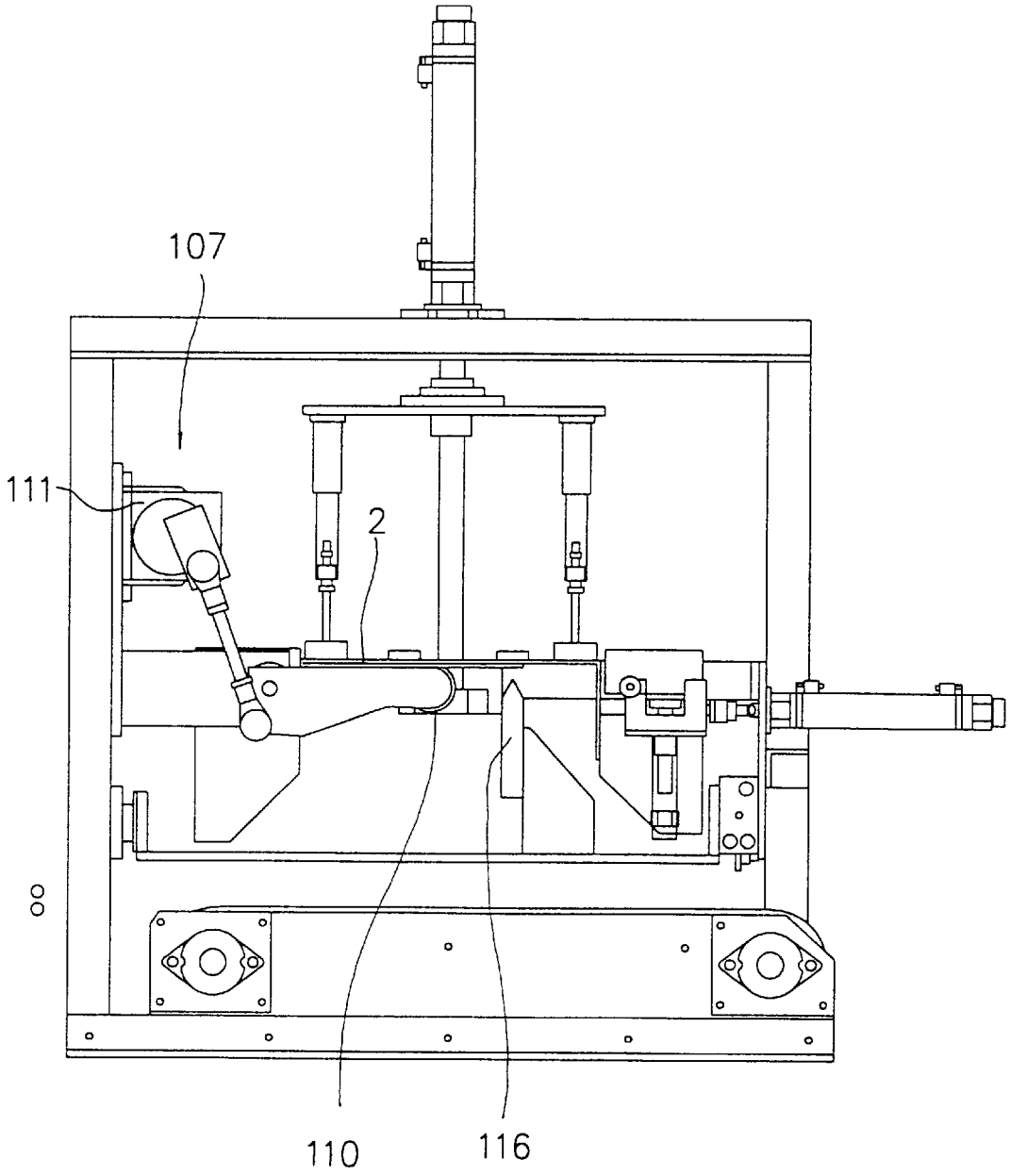
FIG. 35 is a view illustrating a constitution and an operation of a box-assembling section in one embodiment according to the present invention.

As illustrated in FIG. 35, the first folding means 107 begins to function. The motor 111 drives the first folding roller 110 to swing upward. The rear portion of the corrugated cardboard 2 is lifted up to meet the center portion thereof by the first folding roller 110. And then, the adhesive supplying means 116 moves along the guide rail 115 while spraying an adhesive upward. The adhesive is applied to the bottom surface of the rear portion of the corrugated cardboard 2.

Figure 36:
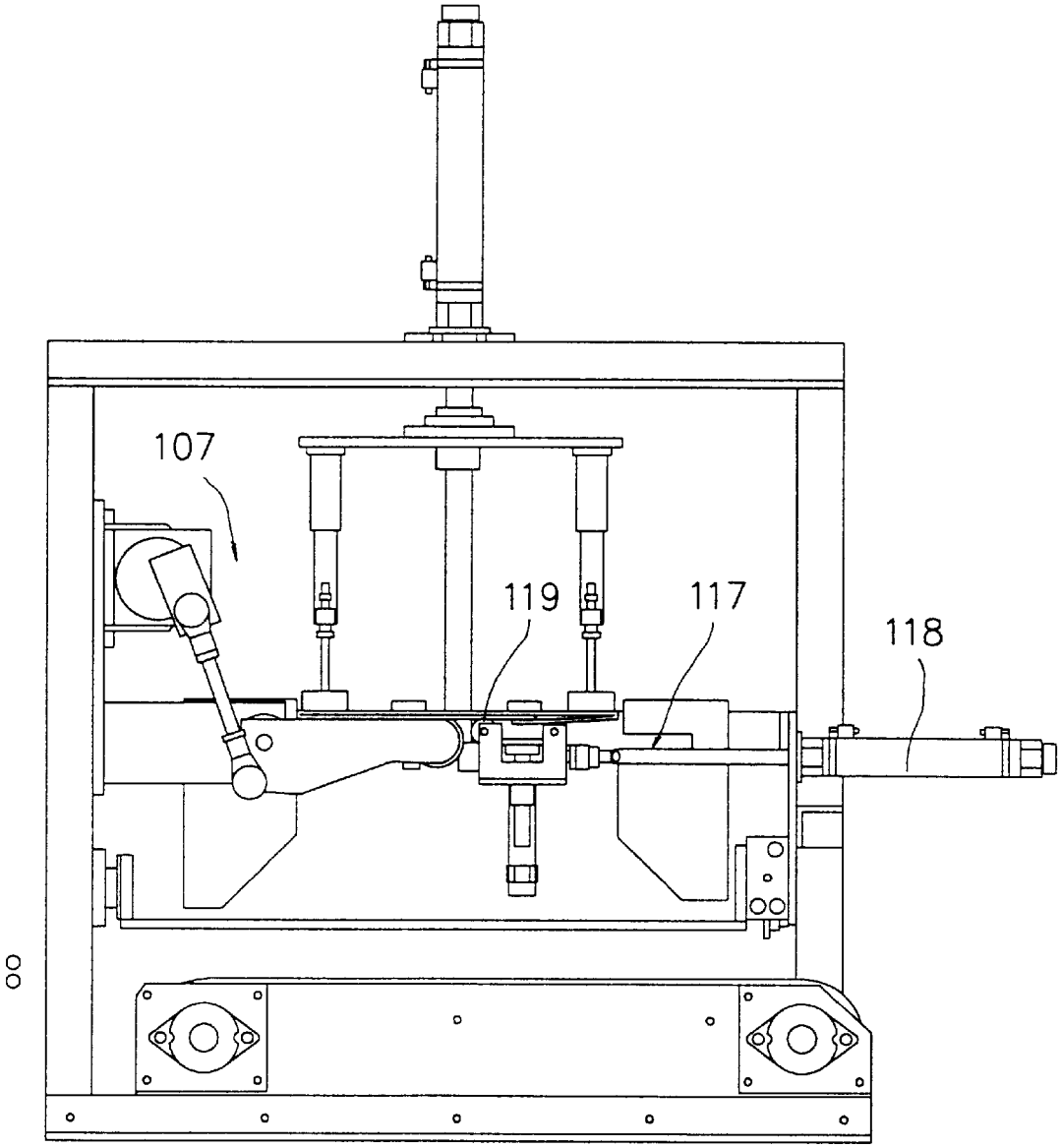
FIG. 36 is a view illustrating a constitution and an operation of a box-assembling section in one embodiment according to the present invention.

As illustrated in FIG. 36, the second folding means 117 begins to function. The air cylinder 118 operates to move the second folding roller 119 inward. The second folding roller 119 lifts up the front portion of the corrugated cardboard 2. The front portion overlaps the bottom surface (the position where the adhesive is applied) of the rear portion lifted by the first folding means 107.

Figure 37:
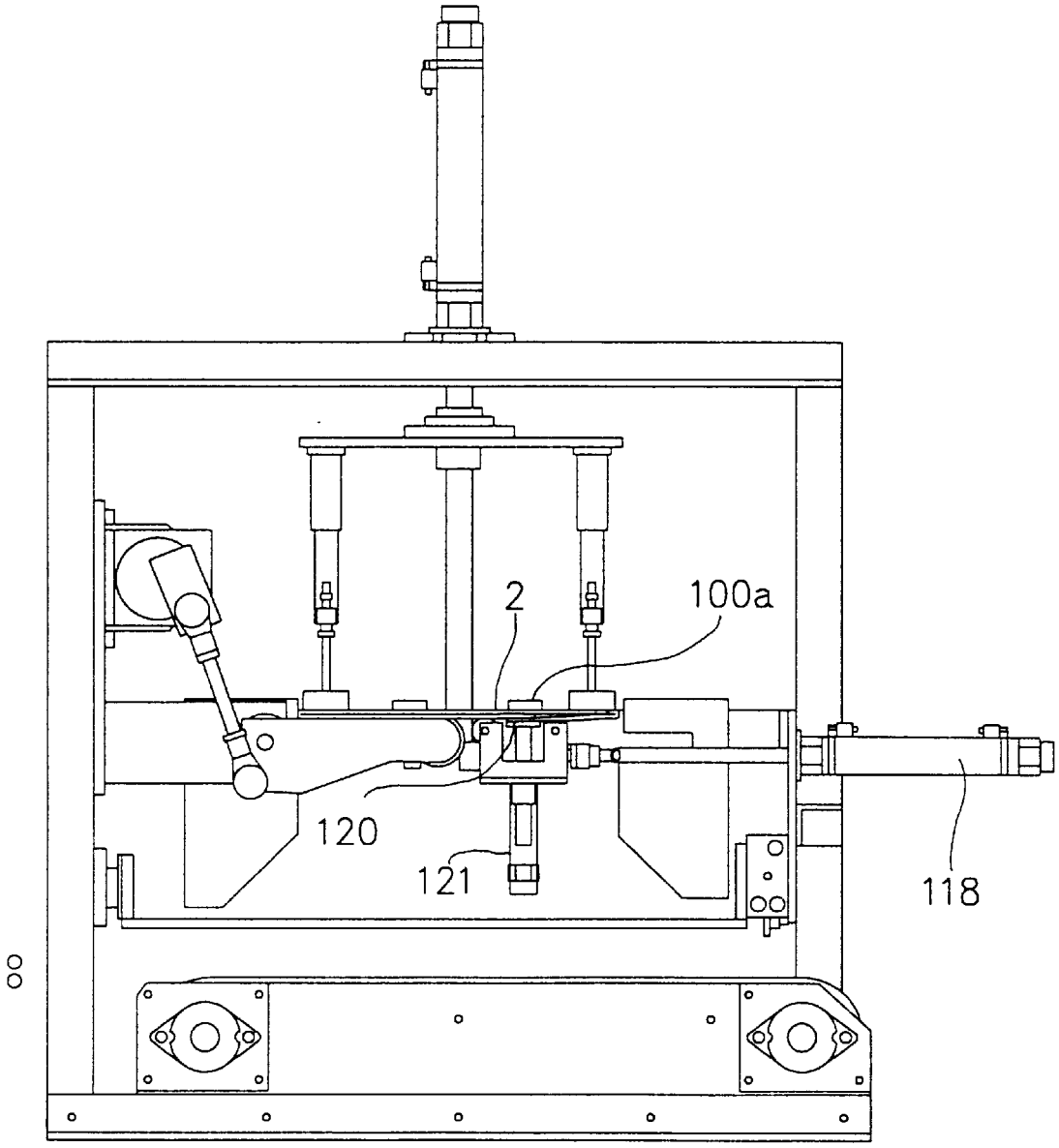
FIG. 37 is a view illustrating a constitution and an operation of a box-assembling section in one embodiment according to the present invention.

As illustrated in FIG. 37, the air cylinder 121 operates to move the press plate 120 upward. The front and rear portions of the corrugated cardboard 2 overlap with each other with the adhesive applied therebetween. The overlapped portions are pressed while being sandwiched between the ascending press plate 120 and the frame 100*a*. On completion of drying the adhesive, the both ends of the corrugated cardboard 2 are fastened together; consequently, the cardboard 2 is loop-shaped.

The first and the second folding means 107 and 117 are restored to the initial position after releasing the corrugated cardboard 2. The holding means 105 halts. The corrugated cardboard 2 is placed on the conveyor belt 101. After the stopper 102 retracts, the conveyor belt 101 resumes its operation. The corrugated cardboard 2 is discharged onto the discharge section 10 disposed adjacent to the box assembling section 9, and then stacked there. The box assembling section 9 utilizes a liquid adhesive (hot-melt adhesive) and the press plate; however, it is possible that a heating plate is adopted instead of the press plate and a solid adhesive is applied to the cardboard 2 after being melted.

As has been described above, according to the present printing machine 1, the identical image is successively printed on the two portions of the single corrugated cardboard 2. Further, the cardboard 2 is discharged outside after being fastened at both the ends by the adhesive. Thus, the cardboard 2 in the appropriate form for being assembled to a box is obtained. Since such operation is successive and automatic, printing on the corrugated cardboard and assembling the same can be conducted in an extremely efficient manner.

In the embodiment as explained above, on the two portions of the single corrugated cardboard, the identical image is printed; however, a subject of stencil printing in the present invention is not limited to the corrugated cardboard. For example, the present invention can be similarly applied to cardboard, a plate or a sheet of a predetermined thickness (made of any material).

Further, it is also possible that an identical image is printed on over three portions of a single printing body by repeating the operation of the elevating section over three times.

Figure 39:
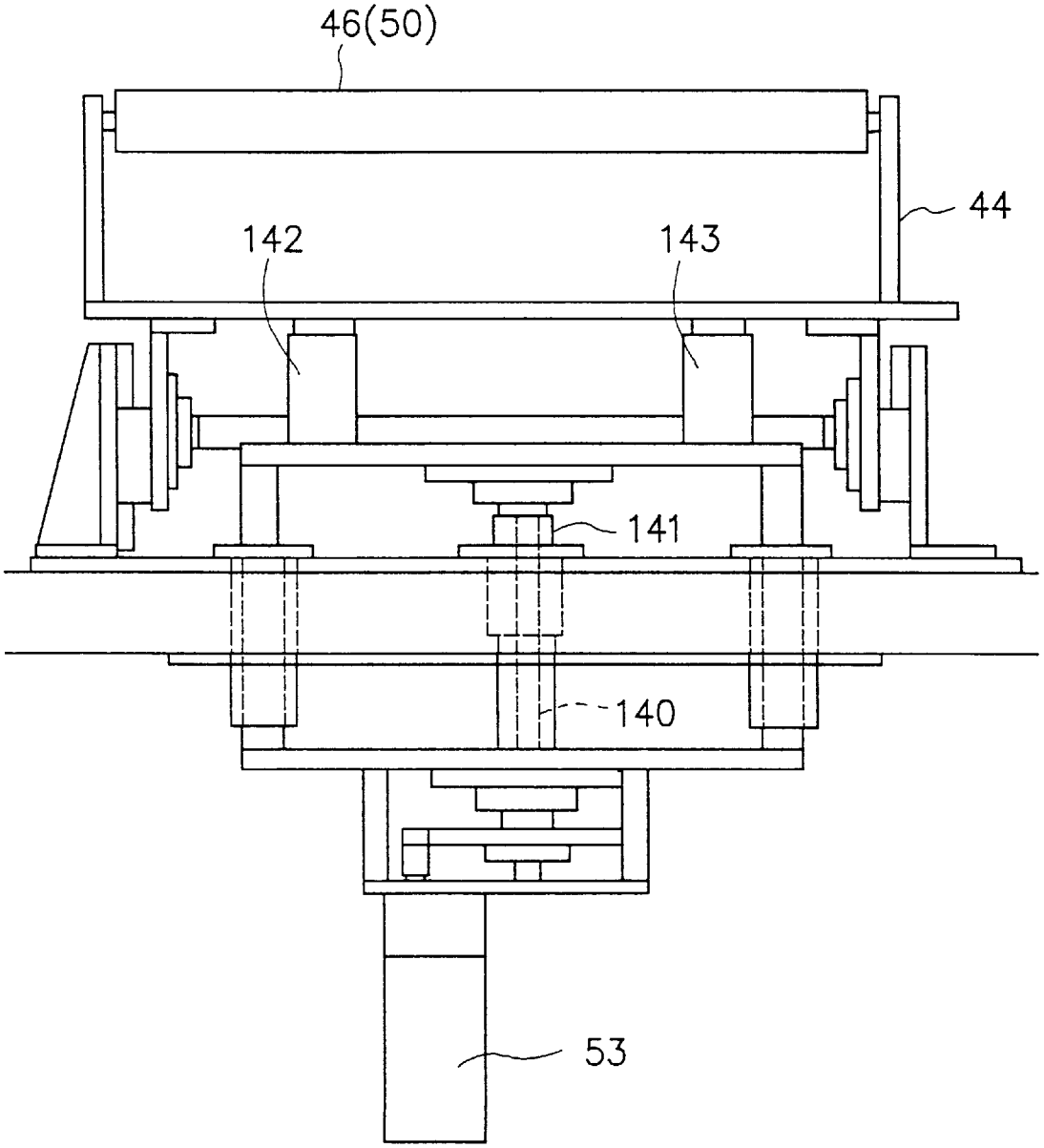
FIG. 39 is a view illustrating an example of a constitution for regulating printing pressure in printing section in one embodiment according to the present invention.

In the present embodiment, the vertically movable base 44 is driven by the adjusting means (motor) 53 so as to be vertically positioned, so that a printing pressure exerted on the corrugated cardboard 2 by the press roller 46 and the printing drum 40 is regulated. However, the printing pressure may be regulated by a constitution as illustrated in FIG. 39. The drawing shows the constitution in which a motor 53 drives a pole screw 140 to reciprocally rotate so that a sleeve 141 meshing with the screw 140 is driven to move vertically, thereby lifting a vertical movement portion 44 supporting a roller 46(50). There are disposed air cylinders 142, 143 between the vertical movement portion 44 and the sleeve 141. The cylinders 142, 143 operate to keep the vertical movement (vertical position) of the portion 44 constant; on the other hand, the printing pressure is regulated by adjusting pressure exerted on the air cylinders 142, 143.

The present machine may be operated by control means like a microcomputer. This control means may be the control means of the drying section. Following a predetermined procedure and utilizing signals from the sensors, this control means can operate each section of the present machine to work automatically and most efficiently.

As has been described above, in a printing machine having a press roller beneath a printing drum, the printing machine according to the present invention has a pair of supporting rollers disposed before and after the printing drum, which rollers can move vertically in synchronization with movement of the press roller; therefore, a printing body can be movably supported in the conveying direction by the rollers. Accordingly, an identical image can be printed successively on different plural portions of a single printing body.

What is claimed is:

1. A printing machine comprising:

a printing drum rotationally driven around a central axis thereof and including a cylindrical circumferential wall with an ink-permeable image area and ink supplying means disposed to an inside of said circumferential wall for supplying ink to an inner surface of said circumferential wall;

a press roller vertically movably disposed below the printing drum, said press roller being adapted to press a printing body to be printed onto the outer surface of the printing drum so that an image of ink is printed onto the printing body;

a first supporting roller disposed before the press roller in a direction of conveying the printing body, said first supporting roller being vertically movable in synchronization with a vertical movement of the press roller, and being adapted to support the printing body so that the printing body is movable in a direction of conveying the printing body; and a second supporting roller disposed after the press roller in the direction of conveying the printing body, said second supporting roller being vertically movable in synchronization with the vertical movement of the press roller, and being adapted to support the printing body so that the printing body is movable in the direction of conveying the printing body.

2. A printing machine comprising:

a printing drum rotationally driven around a central axis thereof and including a cylindrical circumferential wall with an ink-permeable image area and ink supplying means disposed to an inside of said circumferential wall for supplying ink to an inner surface of said circumferential wall;

a press roller vertically movably disposed between a printing position where the press roller and the printing drum hold a printing body and a receiving position below said printing position;

a first supporting roller disposed before the press roller in a direction of conveying the printing body, said first supporting roller being vertically movable in synchronization with a vertical movement of the press roller, and being adapted to support the printing body so that the printing body is movable in the direction of conveying the printing body; and a second supporting roller disposed after the press roller in the direction of conveying the printing body, said second supporting roller being vertically movable in synchronization with the vertical movement of the press roller, and being adapted to support the printing body so that the printing body is movable in the direction of conveying the printing body.

3. A printing machine as defined in claim 2, further comprising a vertically movable base member on which the press roller, the first supporting roller and the second supporting roller are disposed at a same vertical level.

4. A printing machine as defined in claim 3, further comprising a printing body conveyance surface disposed before the first supporting roller in the direction of conveying the printing body at a same vertical level as the receiving position.

5. A printing machine as defined in claim 4, further comprising an idle roller vertically movably disposed above the first supporting roller, said idle roller being adapted to hold the printing body conveyed along the conveyance surface between the first supporting roller and said idle roller.

6. A printing machine as defined in claim 5 wherein, the first supporting roller is driven by driving means connected thereto, and the press roller and the second supporting roller are driven by conveyance of the printing body.

7. A printing machine as defined in claim 6, further comprising a one-way clutch disposed between the first supporting roller and the driving means.

8. A printing machine as defined in claim 7, further comprising detecting means for detecting that a leading end of the printing body reaches the press roller, said printing body being conveyed by the first roller and the idle roller.

9. A printing machine as defined in claim 8, further comprising control means for controlling the printing machine in such a manner that:

the printing drum is set in a print start position;

the printing body is firstly printed by rotating the printing drum after being held by the leading end of the printing body between the printing drum and the press roller;

the base member moves downwardly with the printing body held between the first supporting roller and the idle roller;

the printing drum rotates to be set in the print start position again; and the printing body is secondly printed by rotating the printing drum after being held between the printing drum and the press roller by moving the base member upwardly.

* * * * *